US012590396B2

(12) United States Patent
Lee et al.

(10) Patent No.: US 12,590,396 B2
(45) Date of Patent: Mar. 31, 2026

(54) INTERFACE AND LAUNDRY TREATING APPARATUS HAVING THE SAME

(71) Applicant: LG Electronics Inc., Seoul (KR)

(72) Inventors: Hyunseung Lee, Seoul (KR); Kyuchul Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 18/574,576

(22) PCT Filed: Jun. 28, 2022

(86) PCT No.: PCT/KR2022/009214
§ 371 (c)(1),
(2) Date: Dec. 27, 2023

(87) PCT Pub. No.: WO2023/277516
PCT Pub. Date: Jan. 5, 2023

(65) Prior Publication Data

US 2024/0318370 A1 Sep. 26, 2024

(30) Foreign Application Priority Data

Jun. 30, 2021 (KR) ..... 10-2021-0086115

(51) Int. Cl.

| | |
|---|---|
| ***D06F 34/32*** | (2020.01) |
| ***D06F 34/05*** | (2020.01) |
| ***D06F 34/08*** | (2020.01) |
| ***D06F 34/34*** | (2020.01) |
| *D06F 29/00* | (2006.01) |

(Continued)

(52) U.S. Cl.
CPC ..... *D06F 34/32* (2020.02); *D06F 34/05* (2020.02); *D06F 34/08* (2020.02); *D06F 34/34* (2020.02); *D06F 29/005* (2013.01); *D06F 34/30* (2020.02); *D06F 58/206* (2013.01)

(58) Field of Classification Search
CPC ..... D06F 34/32; D06F 34/08; D06F 34/30; D06F 34/05; D06F 34/34; D06F 29/005; D06F 58/206
See application file for complete search history.

(56) References Cited

U.S. PATENT DOCUMENTS

2007/0294839 A1* 12/2007 Cho ..... D06F 34/30 68/12.02
2009/0201124 A1* 8/2009 Kim ..... G08B 21/18 340/3.71

(Continued)

FOREIGN PATENT DOCUMENTS

CN 107675437 2/2018
CN 107924271 A 4/2018

(Continued)

OTHER PUBLICATIONS

Machine Translation of CN 209468599 U to Peng et al., Oct. 2019. (Year: 2019).*

(Continued)

*Primary Examiner* — Benjamin L Osterhout
(74) *Attorney, Agent, or Firm* — Fish & Richardson P.C.

(57) ABSTRACT

The present disclosure relates to a laundry treating apparatus for positioning a liquid crystal at the center of a manipulation portion when a display including a liquid crystal is installed inside a rotating manipulation portion.

23 Claims, 16 Drawing Sheets

(51) Int. Cl.
*D06F 34/30* (2020.01)
*D06F 58/20* (2006.01)

(56) References Cited

U.S. PATENT DOCUMENTS

| | | | | |
|---|---|---|---|---|
| 2017/0175316 | A1* | 6/2017 | Oh | D06F 34/28 |
| 2017/0260675 | A1* | 9/2017 | Kim | G06F 3/04817 |
| 2017/0321366 | A1 | 11/2017 | Oh et al. | |
| 2018/0202093 | A1 | 7/2018 | Park et al. | |
| 2020/0253073 | A1 | 8/2020 | Cui et al. | |

FOREIGN PATENT DOCUMENTS

| | | | | | |
|---|---|---|---|---|---|
| CN | 209468599 | | | 10/2019 | |
| CN | 209958088 | | | 1/2020 | |
| EP | 3225731 | A1 | * | 10/2017 | D06F 34/28 |
| EP | 4119715 | A1 | * | 1/2023 | G07C 9/00182 |
| EP | 4365347 | A1 | | 5/2024 | |
| JP | 2018-130557 | | | 8/2018 | |
| KR | 20080073453 | A | * | 8/2008 | D06F 33/52 |
| KR | 20160015884 | A | * | 2/2016 | D06F 34/28 |
| KR | 10-2236743 | B1 | | 4/2021 | |

OTHER PUBLICATIONS

Extended European Search Report in European Appln. No. 22833572.5, mailed on Feb. 26, 2025, 8 pages.
International Search Report and Written Opinion in Appln. No. PCT/KR2022/009214, mailed on Oct. 13, 2022, 11 pages.
Office Action in Chinese Appln. No. 202280047284.2, mailed on Dec. 20, 2025, 15 pages (with English translation).

* cited by examiner

[Fig. 14]
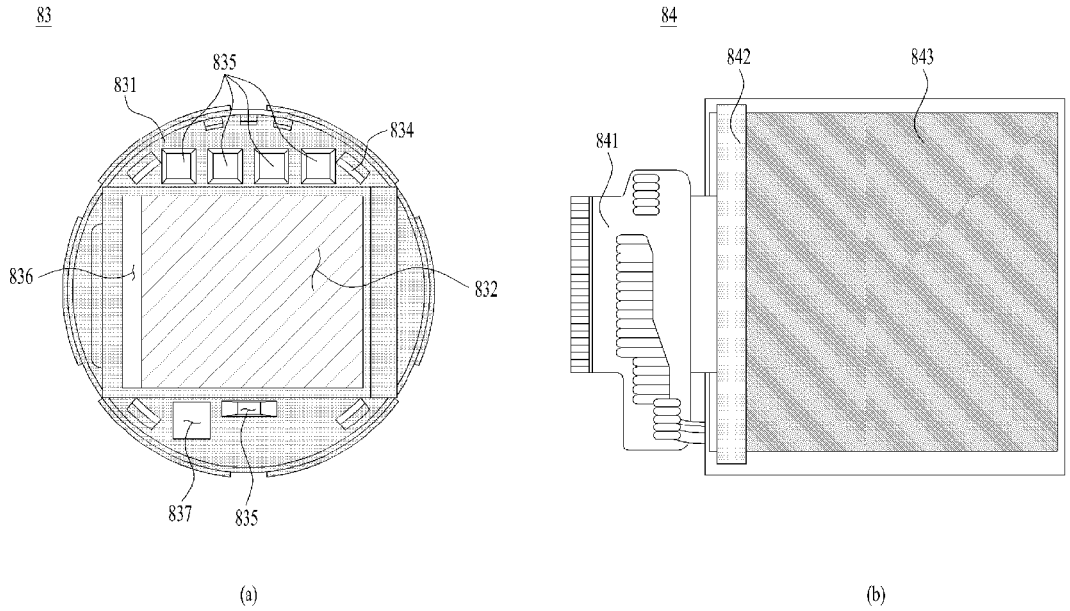
[Fig. 15]
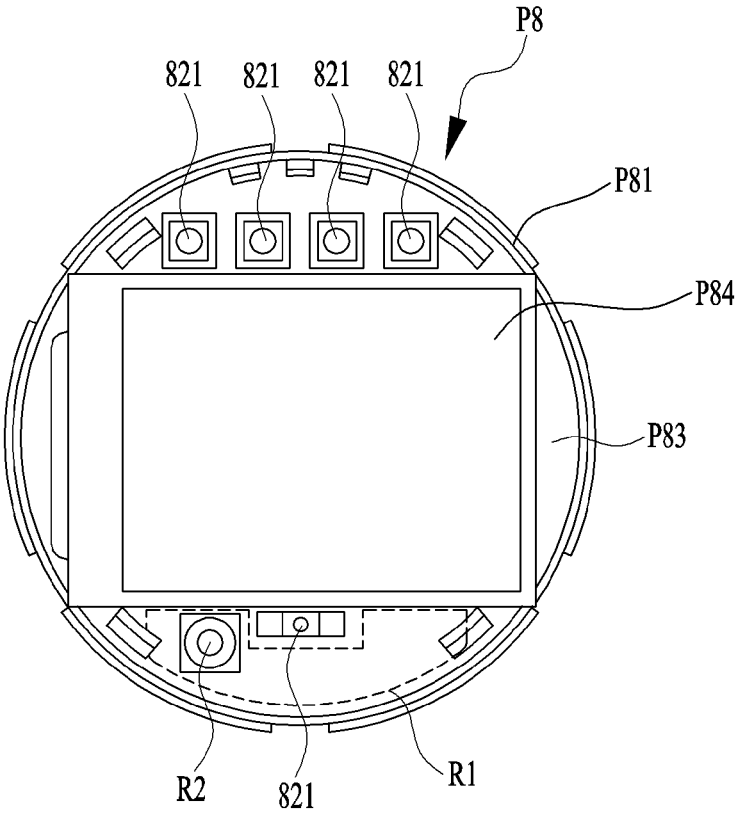

[Fig. 16]
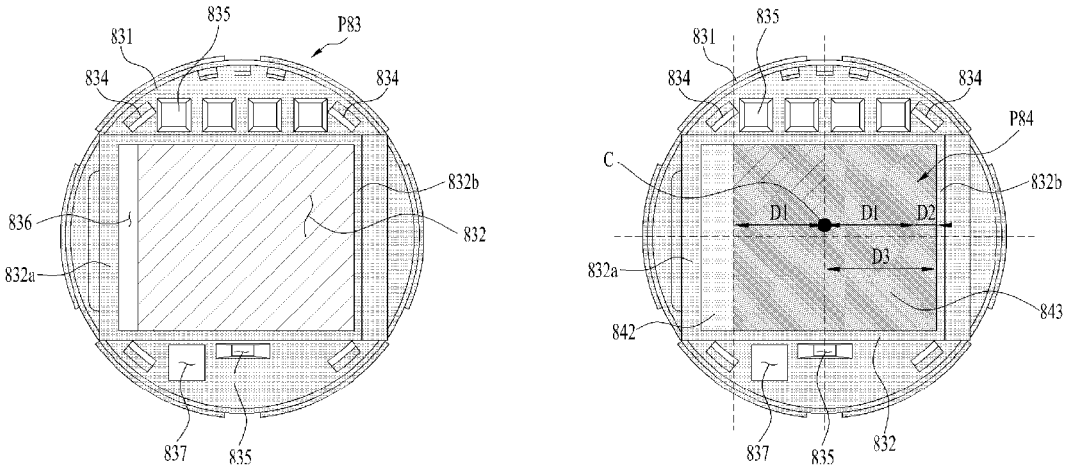
[Fig. 17]
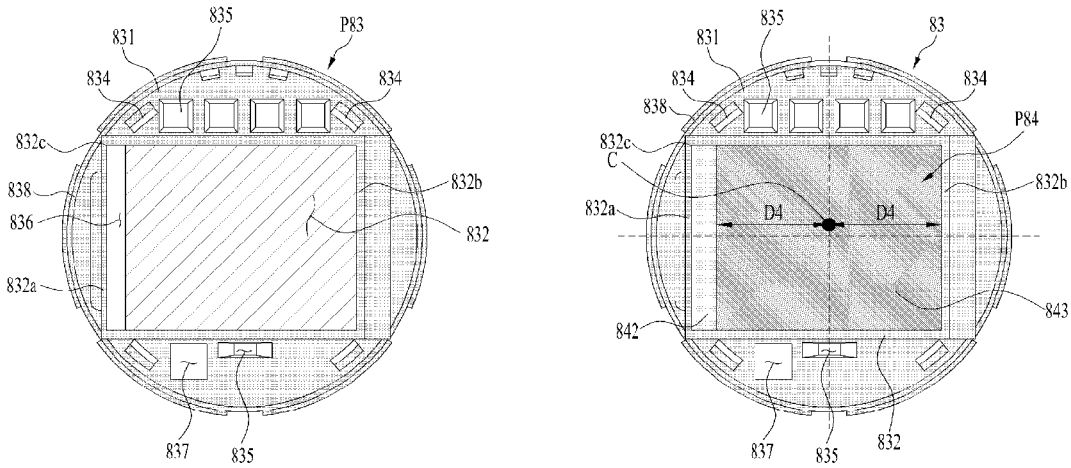

[Fig. 18]
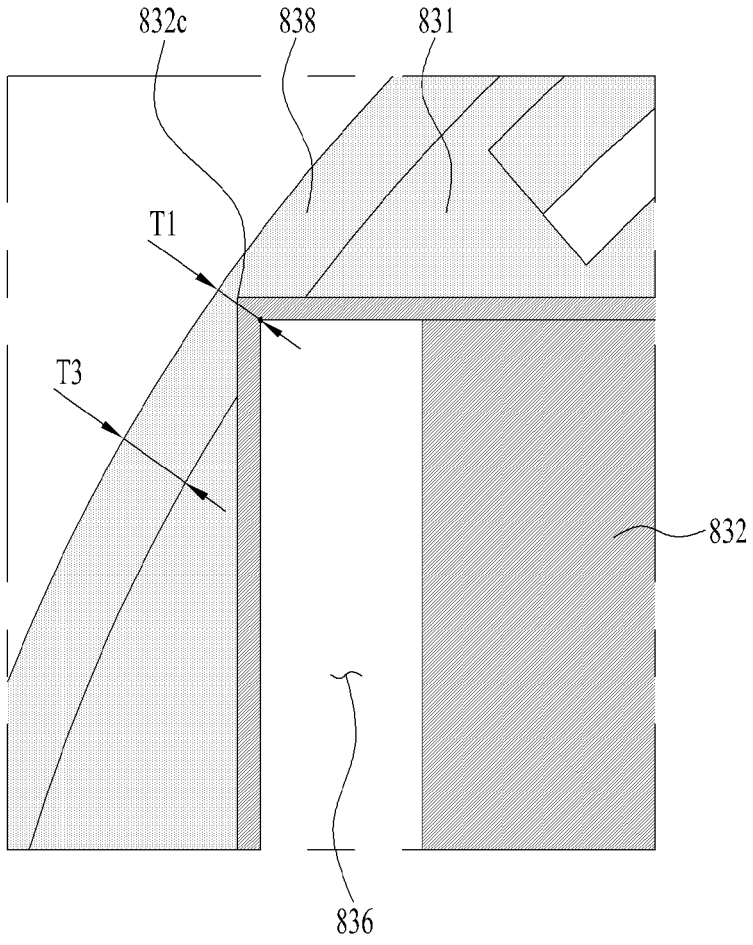

[Fig. 19]
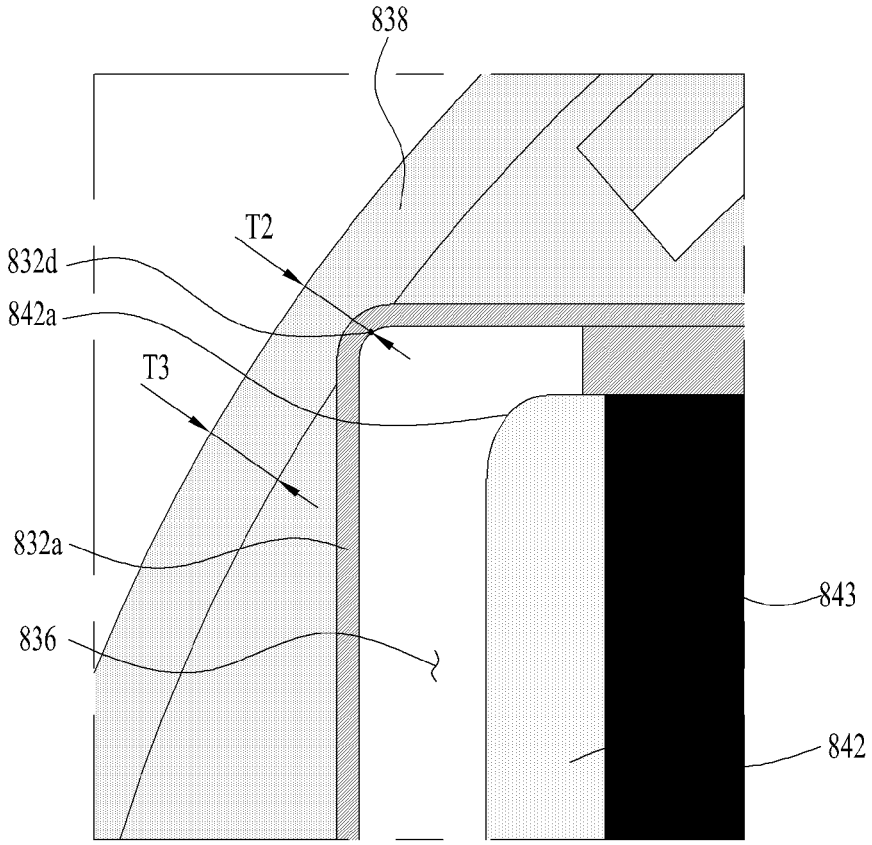

INTERFACE AND LAUNDRY TREATING APPARATUS HAVING THE SAME

CROSS-REFERENCE TO RELATED APPLICATIONS

This application is a National Phase application under 35 U.S.C. 371 of International Application No. PCT/KR2022/009214, filed on Jun. 28, 2022, which claims the benefit of Korean Application No. 10-2021-0086115, filed on Jun. 30, 2021, the contents of which are incorporated by reference herein in their entirety.

TECHNICAL FIELD

This application relates to an interface and a laundry treating apparatus having an interface.

BACKGROUND ART

An input/output device (an interface) for a user to input a control command to an electronic device is essential in the electronic device including a laundry treating apparatus capable of washing, drying, and washing and drying laundry (a common name of an object to be washed or an object to be dried).

The conventional interfaces were designed such that a displaying interface that displays a control command that a user may select, a search interface that allows the user to search for the control command displayed on the displaying interface, a selection portion that allows the user to select the control command displayed on the displaying interface, and input means that requests execution of the control command selected by the user are located in spaces separated from each other (Public No. 10-2014-0023986).

That is, in the conventional interface, a display (an LCD, an LED panel, and the like) on which the control command is displayed, a knob or a button that may search for the control command by allowing a control command executable by the corresponding electronic device to be displayed on the display, a button that inputs a control command to select the control command displayed on the display, a button that inputs a control command to request execution of the selected control command, and the like are located in spaces separated from each other. Such an arrangement was a factor determining a design of the interface (a design of the control panel) located on a front face of the electronic device such as the laundry treating apparatus.

In the conventional interface of the above structure, because the devices including the display had to be dispersedly arranged along a width direction of the electronic device or distributed along a height direction of the electronic device, a great space was required for installation of the interface.

In the case of a conventional laundry treating apparatus including a knob or the like, a course and an option are selected by rotating the knob. When the knob is rotated, a course and option corresponding to the knob is selected, and when the knob is positioned at a course and option desired by a user, the user may then operate the laundry treating apparatus by pressing a run button.

The conventional laundry treating apparatus further includes a displaying interface for displaying the state of the laundry treating apparatus.

The displaying interface includes a liquid crystal, a harness coupled thereto to transmit an electrical signal to the liquid crystal, and a control line extending from the harness and coupled to a control panel, and is coupled to the cabinet. The harness is coupled to one side of the liquid crystal to form a surface of the displaying interface with the liquid crystal. Accordingly, since the liquid crystal is disposed on one side of the harness, the liquid crystal is disposed on one side with respect to the entire area of the displaying interface.

Even if the liquid crystal is placed inclined to one side due to the harness, since an area in which the displaying interface is to be installed in the cabinet is large, a space for changing the positions of the liquid crystal and the harness is large.

However, when the displaying interface is designed to be disposed within the knob, a space inside the knob is limited, and thus there is a problem in that the liquid crystal is arranged to be tilted to one side inside the knob.

Accordingly, the conventional laundry treating apparatus has a fundamental problem in that it is difficult to arrange the liquid crystal to be centrally disposed inside the knob. Therefore, when the displaying interface is disposed inside the knob, it is not possible to expect aesthetics sensation, and users may misunderstand that the laundry treating apparatus itself is a defective product.

DISCLOSURE OF INVENTION

Technical Problem

The present disclosure is to provide a laundry treating apparatus for positioning a liquid crystal at the center of a manipulation portion when a displaying interface including a liquid crystal is installed inside a rotating manipulation portion.

The present disclosure is to provide a laundry treating apparatus for disposing a harness coupled to one surface of the liquid crystal to be close to an inner circumferential surface of the manipulation portion.

The present disclosure is to provide a laundry treating apparatus for compensating for presence of the harness by disposing the displaying interface including the liquid crystal to be inclined to one side inside the manipulation portion.

The present disclosure is to provide a laundry treating apparatus for extending the area of the liquid crystal with a rectangular shape to the maximum inside the manipulation portion.

Solution to Problem

To solve the above problems, the present disclosure provides a laundry treating apparatus for placing a liquid crystal displaying an image at the center of a manipulation portion by disposing a rectangular display to be inclined to one side inside a circular manipulation portion that is rotatably provided.

The liquid crystal for displaying an image may be disposed at the center of the manipulation portion by placing a harness, in which it is not possible to display an image on the displaying interface, to be the most adjacent to the manipulation portion.

The displaying interface may be disposed inclined toward the harness by a length corresponding to the thickness of the harness.

The displaying interface may include a display configured to display the selected course, a mounting portion that is fixed to the cabinet inside the manipulation portion and on which the display is mounted, and a circuit board accommodated on the mounting portion and configured to control the display.

The display may include a liquid crystal configured to visually display the selected course, a control line extending from the circuit board and configured to transmit a signal of the circuit board to the liquid crystal, and a harness disposed on one surface of the liquid crystal and connected to the control line.

In the mounting portion, the harness may be disposed closer to an inner circumferential surface than the liquid crystal to place the liquid crystal at the center.

In the mounting portion, the harness may be disposed closer to the inner circumferential surface than an outer surface of the liquid crystal to match an interval between the center of the mounting portion and the outer surface of the liquid crystal corresponds to an interval between the center of the mounting portion and an inner surface of the harness.

The mounting portion may include a mounting body provided inside the manipulation portion and configured to support the liquid crystal and the harness, and a seating groove recessed from the mounting body or having a protruding circumference to define a space in which the liquid crystal and the harness are accommodated.

The seating groove may be disposed inclined toward a direction in which the harness is disposed in the mounting body.

The seating groove may be disposed inclined toward an inner circumferential surface of the mounting body from the center of the mounting body by the width of the harness.

The seating groove may include a first surface facing an outer surface of the harness, and a second surface facing an outer surface of the liquid crystal and disposed at an opposite side to the first surface.

The first surface may be disposed closer to the inner circumferential surface of the mounting body than the second surface.

A vertex of the first surface may be disposed closer to the inner circumferential surface of the mounting body than a vertex of the second surface.

An interval between the vertex of the first surface and the inner circumferential surface of the mounting body may be smaller than an interval between the vertex of the second surface and the inner circumferential surface of the mounting body.

The displaying interface may include a window disposed in front of the mounting portion and configured to shield a surface of the display from being exposed to the outside.

The mounting portion may include a support surface that protrudes along a circumference of the mounting body and on which the window is accommodated, and the first surface may be disposed closer to the support surface than the second surface.

The vertex of the first surface may be disposed by being inserted into the support surface.

A portion of the support surface, which faces the vertex of the first surface, may have a thinner thickness than other portions.

At least one of both vertexes of the first surface may include a curved portion have a radius of curvature.

Both ends of the harness may include a curved portion engaged with the curved portion.

The curved portion of the both ends of the second surface may be omitted, and the chamfering of both ends of the liquid crystal may be omitted.

The vertex of the first surface may be disposed through the support surface.

A portion of the support surface, which corresponds to both ends of the first surface, may be provided via penetration.

The seating groove may be provided through the mounting body to allow the control line to pass therethrough, and may include a connector through-hole facing at least a portion of the harness. The connector through-hole may be disposed closer to the first surface than the second surface.

The first surface may be disposed to face an outer surface of the connector through-hole.

Advantageous Effects of Invention

According to the present disclosure, when a displaying interface including a liquid crystal is installed inside a rotating manipulation portion, the liquid crystal may be positioned at the center of the manipulation portion.

According to the present disclosure, a harness coupled to one surface of the liquid crystal may be disposed in close contact with an inner circumferential surface of the manipulation portion.

According to the present disclosure, present of the harness may be compensated for by placing the displaying interface including the liquid crystal to be inclined to one side inside the manipulation portion.

According to the present disclosure, the area of a rectangular liquid crystal may be maximized inside the circular manipulation portion.

BRIEF DESCRIPTION OF DRAWINGS

FIG. 4 shows a detailed structure of a water collecting portion 37, a heat exchanger 4, a washer 6, and the like.

FIG. 14 is a diagram showing display arrangement of a displaying interface according to the present disclosure.

FIG. 15 shows a layout of a displaying interface according to the present disclosure.

FIG. 16 shows an improved structure of display arrangement of a displaying interface according to the present disclosure.

FIG. 17 shows the structure of a mounting portion for mounting a display in a displaying interface according to the present disclosure.

FIG. 18 shows another embodiment of the mounting portion.

FIG. 19 shows a last embodiment of the mounting portion.

MODE FOR THE INVENTION

Figure 1:
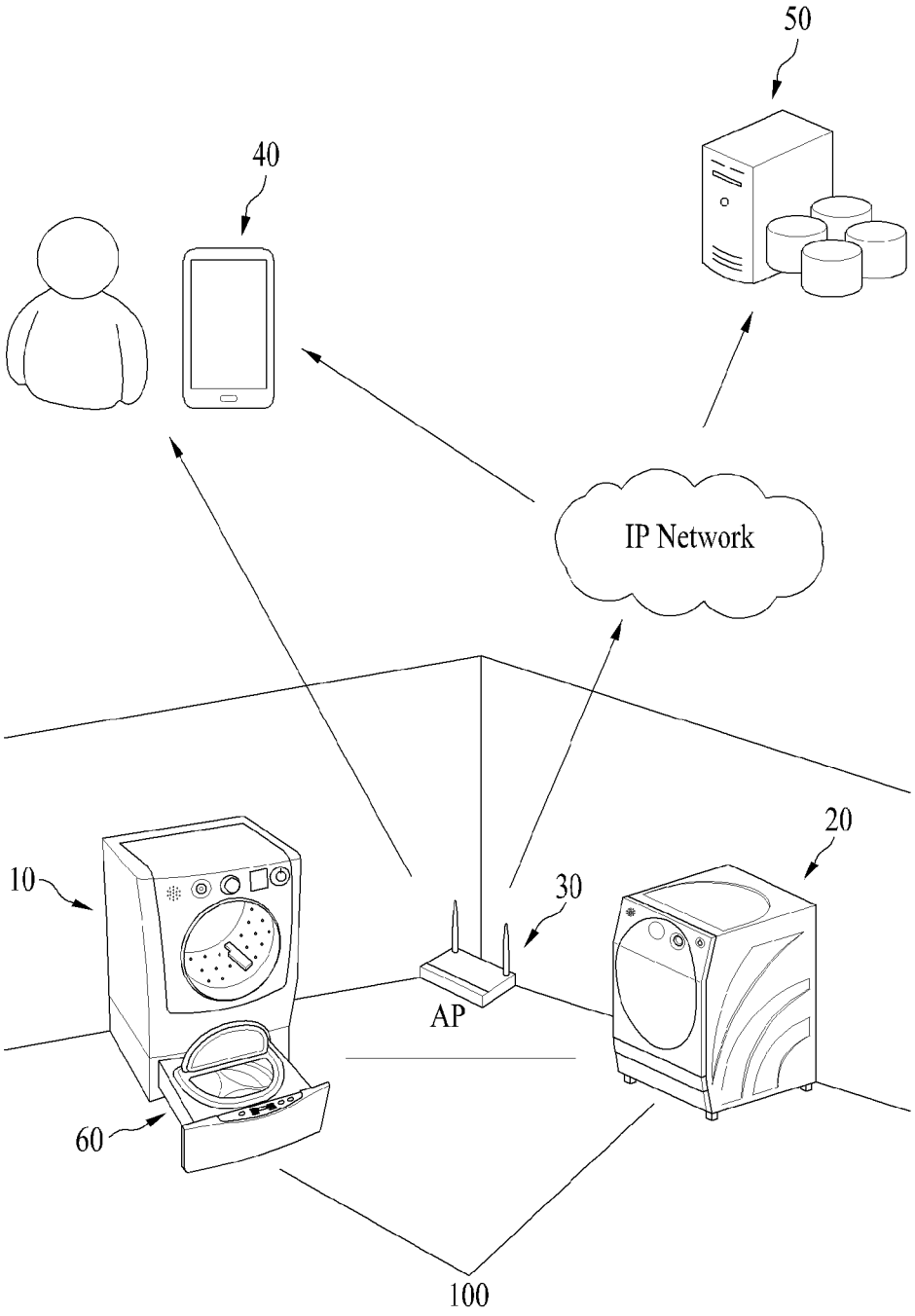
FIG. 1 shows a home appliance system and an online system in which laundry treating apparatuses of the present disclosure are arranged.

Hereinafter, embodiments disclosed in the present specification will be described in detail with reference to the accompanying drawings. In the present specification, even in different embodiments, the same and similar reference numerals are assigned to the same and similar components, and the description thereof is replaced with the first description. As used herein, the singular expression includes the plural expression unless the context clearly dictates otherwise. In addition, in describing the embodiments disclosed herein, when it is determined that a detailed description of a related known technology may obscure the gist of the embodiments disclosed herein, a detailed description thereof will be omitted. In addition, the accompanying drawings are only for casy understanding of the embodiments disclosed in the present specification, and it should be noted that the technical idea disclosed in the present specification is not to be construed as being limited by the accompanying drawings.

FIG. 1 shows a home appliance system and an online system in which a laundry treating apparatus of the present disclosure is disposed.

The laundry treating apparatus of the present disclosure may include a laundry washing apparatus 10 that performs an arbitrary washing course or washing option that performs a washing cycle for removing foreign substances from laundry using water and detergent, and a mini apparatus 60 that is disposed near or beneath the laundry washing apparatus and performs the arbitrary washing course or washing option that performs the washing cycle for removing the foreign substances from the laundry using the water and the detergent.

The laundry washing apparatus 10 may be of a front load type in which the laundry is put into the laundry washing apparatus 10 from a front face thereof, and the mini apparatus 60 may be of a top load type in which the laundry is put into the mini apparatus 60 from a top face thereof.

As shown, the mini apparatus 60 may be disposed beneath the laundry washing apparatus 10 to increase a vertical level of a laundry inlet of the laundry washing apparatus 10. In this case, the mini apparatus 60 may be of a drawer type of being extended frontwards such that a laundry inlet thereof into which the laundry is put is exposed.

In addition, the mini apparatus 60 may be disposed on top of the laundry washing apparatus 10. Accordingly, a user may easily access the mini apparatus 60.

In one example, the laundry treating apparatus of the present disclosure may include a laundry drying apparatus 20 that performs an arbitrary drying course or drying option that dries the laundry containing moisture after the washing is completed in the laundry washing apparatus 10 or the mini apparatus 60.

The user may arrange the laundry washing apparatus 10 and the laundry drying apparatus 20 among the laundry treating apparatus of the present disclosure together in the room, and may include all of the components of the laundry treating apparatus by additionally including the mini apparatus 60.

Accordingly, the mini apparatus 60 may wash laundry that has a relatively small volume and is frequently washed, such as underwear and baby clothes. In addition, the laundry washing apparatus 10 may wash laundry that has a large volume and is in-frequently washed, such as jeans and quilts.

In one example, at least one of the laundry washing apparatus 10, the laundry drying apparatus 20, and the mini apparatus 60 may access an Internet network via a router (AP) 30. At least one of the laundry washing apparatus 10, the laundry drying apparatus 20, and the mini apparatus 60 may have a communication module to connect to the router, and a server 50 provided by a producer who produced the laundry treating apparatus may recognize the laundry washing apparatus 10, the laundry drying apparatus 20, and the mini apparatus 60 via port information of the router 30 and register and control the laundry washing apparatus 10, the laundry drying apparatus 20, and the mini apparatus 60.

When the user has an external terminal 40 equipped with a communication module, such as a smartphone, the user may access the server 50 via the Internet network with the external terminal 40 to control at least one of the laundry washing apparatus 10, the laundry drying apparatus 20, and the mini apparatus 60.

In addition, the user may register at least one of the laundry washing apparatus 10, the laundry drying apparatus 20, and the mini apparatus 60 to the server 50 via the external terminal 40.

In addition, when there is notification information or there is an update of the course or the option for at least one of the laundry washing apparatus 10, the laundry drying apparatus 20, and the mini apparatus 60, the server 50 may notify the user with the external terminal 40.

In one example, the laundry washing apparatus 10, the laundry drying apparatus 20, and the mini apparatus 60 may be configured to be in communication with each other.

One of the laundry washing apparatus 10, the laundry drying apparatus 20, and the mini apparatus 60 may be configured to be in communication with the other two via the router 30 and the server 50. To this end, each of the laundry washing apparatus 10, the laundry drying apparatus 20, and the mini apparatus 60 may include the communication module such as WIFI.

In addition, the laundry washing apparatus 10, the laundry drying apparatus 20, and the mini apparatus 60 may be configured to be in communication with each other without via the server 50. For example, the laundry washing apparatus 10, the laundry drying apparatus 20, and the mini apparatus 60 may be configured to be in communication with each other via a Bluetooth communication module.

The laundry washing apparatus 10, the laundry drying apparatus 20, and the mini apparatus 60 may be configured to be in communication with each other to share the states thereof with each other and to display each other's states.

For example, the user may identify the states of the laundry drying apparatus 20 and the mini apparatus 60 via the laundry washing apparatus 10. Therefore, even when the laundry drying apparatus 20 and the mini apparatus 60 are disposed to be spaced apart from the laundry washing apparatus 10 or are disposed at positions where the laundry drying apparatus 20 and the mini apparatus 60 are not visible when the user looks at the laundry washing apparatus 10, the user may display the states of the laundry drying apparatus 20 and the mini apparatus 60 via the laundry washing apparatus 10.

The laundry washing apparatus 10, the laundry drying apparatus 20, and the mini apparatus 60 may be configured to share names of a course or option thereof, a selected state of the course or option thereof, a executed state of the course or option thereof, a completion state of the course or option thereof, and an error or notification state thereof with each other or display each other's names and states of the courses or options and error or notification states.

In addition, one of the laundry washing apparatus 10, the laundry drying apparatus 20, and the mini apparatus 60 may be configured to manipulate the other two with a manipulation portion thereof for receiving a command.

The laundry washing apparatus 10, the laundry drying apparatus 20, and the mini apparatus 60 may transmit and receive control commands to and from each other via the respective communication modules thereof or the server 50.

Accordingly, even when the laundry washing apparatus 10, the laundry drying apparatus 20, and the mini apparatus 60 are spaced apart from each other, the user may control another device with one device, thereby improving convenience.

Figure 2:
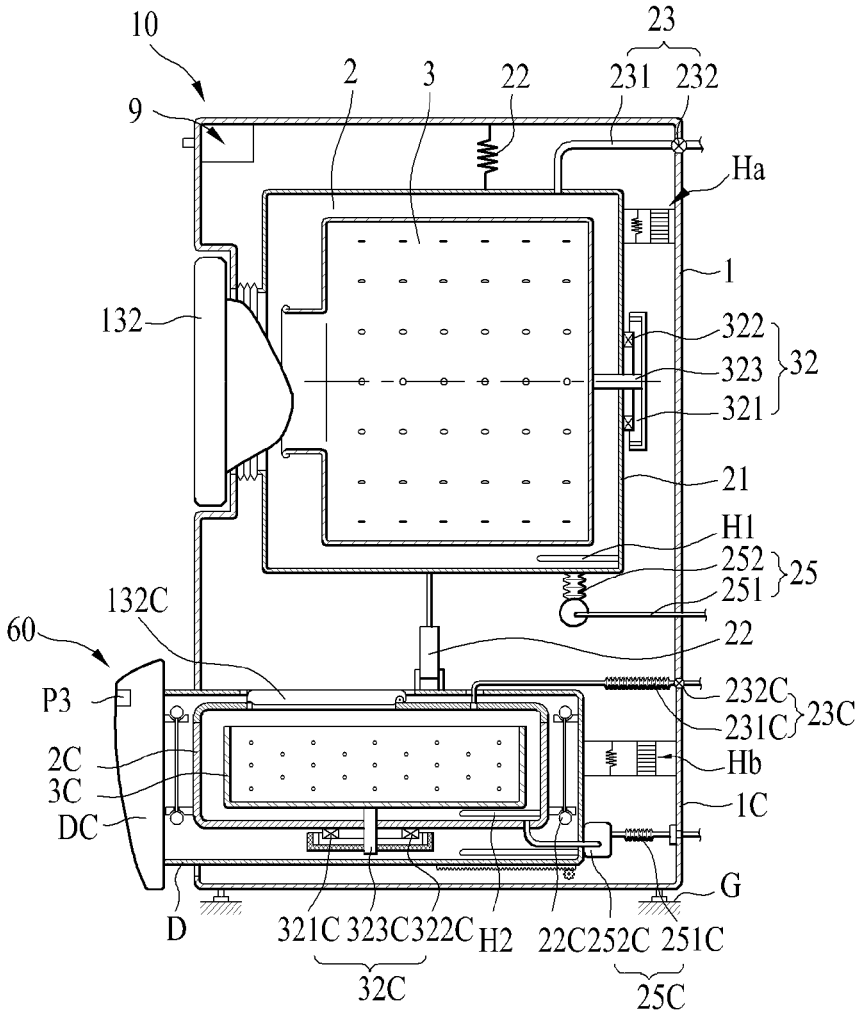
FIG. 2 shows an embodiment of an internal structure of a laundry washing apparatus 10 and a mini apparatus 60.

FIG. 2 shows an embodiment of internal structures of the laundry washing apparatus 10 and the mini apparatus 60.

Unlike the drawing, the laundry washing apparatus 10 and the mini apparatus 60 may be independently constructed to be separated from each other.

The laundry washing apparatus 10 may include a cabinet 1 that forms an appearance of the laundry washing apparatus, a tub 2 that is accommodated in the cabinet 1 and stores water therein, a drum 3 that is rotatably disposed in the tub 2 and stores water therein, a driver 32 that is coupled to the tub 2 to rotate the drum 3, a water supply 23 that is constructed to supply water to the tub 2, and a drainage 25 constructed to drain water of the tub 2.

Each of the tub 2 and the drum 3 may have the laundry inlet for putting the laundry into the laundry washing apparatus in a front face thereof, and the cabinet 1 may further include a door 132 for opening and closing the laundry inlet.

The driver 32 may include a stator 321 coupled to a rear face of the tub 2, a rotor 322 rotated by the stator 321, and a rotation shaft 323 coupled to the rotor 322 to rotate the drum 3.

The water supply 23 may include a water supply pipe 231 that allows an external water supply source and the tub 2 to be in communication with each other, and a water supply valve 232 that opens and closes the water supply pipe 231.

In one example, the water supply 23 may further include a detergent box that is able to be extended forwardly of the cabinet 1 and is constructed to put detergent into the tub 2, and the water supply pipe 231 may be in communication with the detergent box.

The drainage 25 may include a drain pipe 251 disposed below the tub 2, and a drain pump 252 coupled to the drain pipe 252 to provide power for discharging water.

The laundry washing apparatus 10 may further include a support 22 that supports the tub 2 to the cabinet 1, and a heater H1 that heats water inside the tub 2.

In addition, the laundry washing apparatus 10 may further include a hot air supply Ha constructed to supply hot air to the tub 2.

In one example, the laundry washing apparatus 10 may include a control panel P or a washing controller that receives a command for displaying or controlling the state of the laundry washing apparatus 10. The control panel P may be disposed coupled to the cabinet 1.

In addition, the control panel P may operate at least one of the driver 32, the water supply valve 232, the drain pump 252, the heater H1, and the hot air supply Ha to perform the arbitrary washing course and washing option for removing the foreign substances from the laundry. The washing course and the washing option may be composed of a series of control methods capable of performing all of a washing cycle, a rinsing cycle, and a dehydration cycle.

The mini apparatus 60 may include a mini cabinet 1C that forms an appearance of the mini cabinet, a mini tub 2C that is accommodated in the mini cabinet 1C and stores water therein, a mini drum 3C that is rotatably disposed in the mini tub 2C and stores water therein, a mini driver 32C that is coupled to the mini tub 2C to rotate the mini drum 3C, a mini water supply 23C constructed to supply water to the mini tub 2C, and a mini drainage 25C constructed to drain water of the mini tub 2C.

The mini cabinet 1C may be disposed beneath the cabinet 1 to support the cabinet 1. It is not excluded that the mini cabinet is placed on top of the cabinet 1.

The mini cabinet may be formed integrally with the cabinet 1.

Each of the mini tub 2C and the mini drum 3C may have the laundry inlet for putting the laundry into the mini apparatus in a top face thereof, and the mini laundry cabinet 1C may further include a mini door 132C for opening and closing the laundry inlet.

The mini driver 32C may include a mini stator 321C coupled to a bottom face of the mini tub 2C, a mini rotor 322C rotated by the mini stator 321C, and a mini rotation shaft 323C coupled to the mini rotor 322C to rotate the mini drum 3C.

The mini water supply 23C may include a mini water supply pipe 231C that allows the external water source and the mini tub 2C to be in communication with each other, and a mini water supply valve 232C that opens and closes the mini water supply pipe 231C.

In one example, the mini water supply 23C may further include a mini detergent box that is able to be extended forwardly of the cabinet 1 and is constructed to put the detergent into the mini tub 2C, and the mini water supply pipe 231C may be in communication with the detergent box.

The mini drainage 25C may include a mini drain pipe 251C disposed below the mini tub 2C, and a mini drain pump 252C coupled to the mini drain pipe 252C to provide power for discharging water.

The mini apparatus 60 may further include a mini support 22C that supports the mini tub 2C to the mini cabinet 1C, and a mini heater H2 that heats water inside the mini tub 2C.

In addition, the mini apparatus 60 may further include a hot air supply Hb constructed to supply hot air to the mini tub 2C.

In one example, the mini apparatus 60 may include a mini control panel PC or a mini controller that receives a command for displaying or controlling the state of the mini apparatus 60. The mini control panel PC may be disposed coupled to the mini cabinet 1C.

In addition, the mini control panel PC may operate at least one of the mini driver 32C, the mini water supply valve 232C, the mini drain pump 252C, the mini heater H2, and the mini hot air supply HaC to perform the arbitrary washing course and washing option for removing the foreign substances from the laundry. The washing course and the washing option may be composed of a series of control methods capable of performing all of the washing cycle, the rinsing cycle, and the dehydration cycle.

The mini apparatus 60 may further include a drawer D that is able to be extended forwardly of the mini cabinet 1*c* and accommodates the mini tub 2*c* therein. The drawer D may include a front cover DC at a front face thereof to open and close an entrance through which the drawer D is extended from the mini cabinet 1C.

The mini control panel PC may be disposed on the front cover DC.

Figure 3:
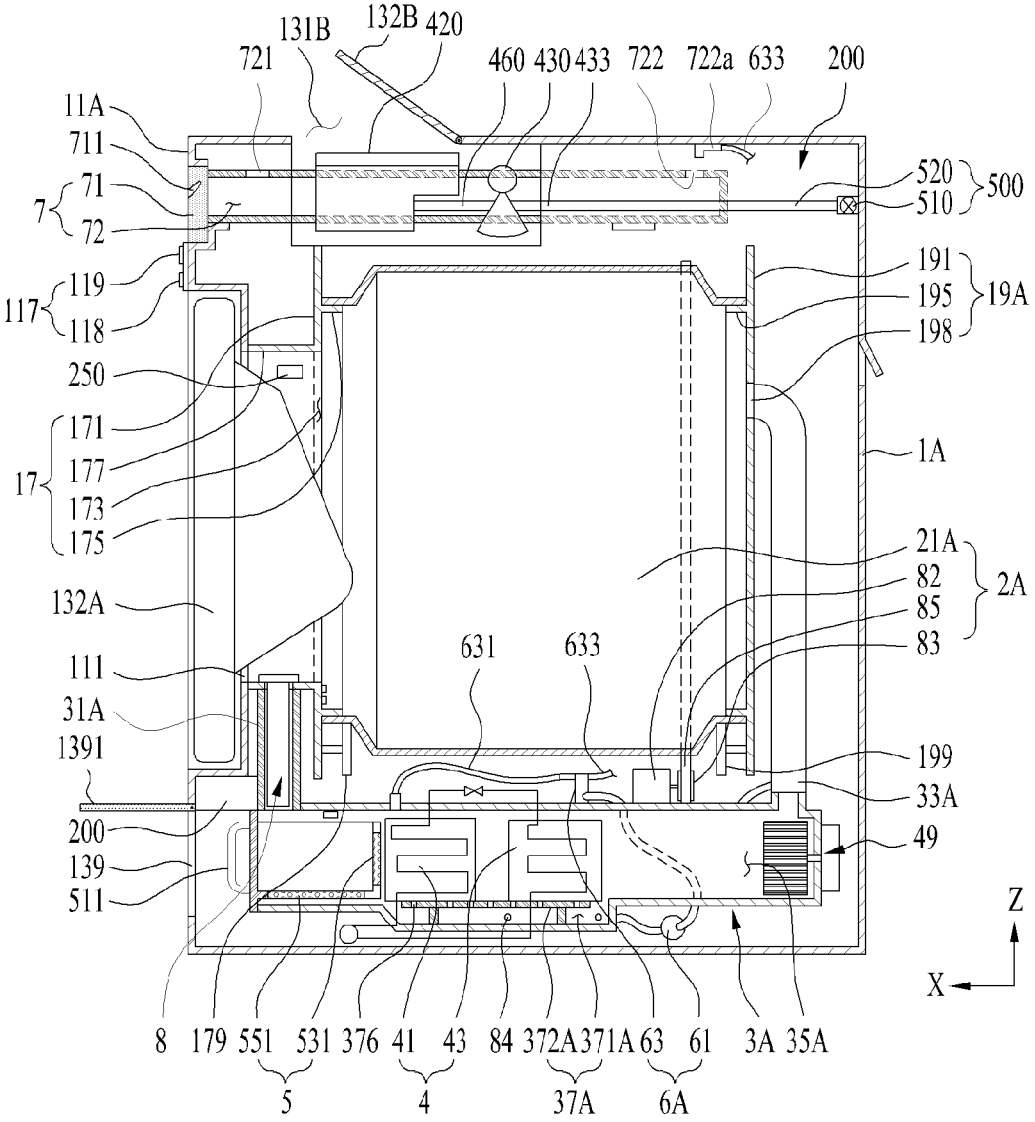
FIG. 3 shows a structure of a laundry dry apparatus among laundry treating apparatuses of the present disclosure.

FIG. 3 shows a structure of the laundry drying apparatus 20 of the laundry treating apparatus of the present disclosure.

The laundry drying apparatus 20 may include a drying cabinet 1A, a drying drum 2A that is rotatably disposed inside the drying cabinet to provide a space for storing the laundry, a circulation flow path 3A that forms a flow path for re-supplying air discharged from the drying drum 2 to the drying drum 2A, and a heat exchanger 4 that dehumidifies and heats air introduced into the circulation flow path 3A and then re-supplies dehumidified and heated air to the drying drum 2A.

When the drying drum 2A is formed as a cylindrical drum body 21A with open front face and rear face, a first support 17 that rotatably supports the front face of the drying drum 2A and a second support 19A that rotatably supports the rear face of drying drum 2A may be disposed inside the cabinet 1A.

The first support 17 may include a first fixed body 171 fixed inside the drying cabinet 1A, a drum laundry inlet 173 defined to extend through the first fixed body to allow the laundry inlet 111 and an interior of the drum body 21A to be in communication with each other, and a first support body 175 disposed on the first fixed body 171 and inserted into a front face (a first open face) of the drum body 21A.

The first fixed body 171 may be in any shape as long as the drum laundry inlet 173 and the first support body 175 are able to be disposed. The first support body 175 may be formed in a pipe shape protruding from the first fixed body 171 toward the drying drum body 21A. A diameter of the first support body 175 may be larger than a diameter of the drum laundry inlet 173, and may be smaller than a diameter of a front face of the drying drum body 21A. In this case, the drum laundry inlet 173 will be located inside the space defined by the first support body 175.

The first support 17 may further include a connection body 177 that connects the laundry inlet 111 and the drum laundry inlet 173 to each other. The connection body 177 may be formed in a pipe shape extending from the drum laundry inlet 173 toward the laundry inlet 111. The connection body 177 may have an air outlet 178 in communication with the circulation flow path 3A.

The air outlet 178, as a passage that allows air inside the drying drum body 21A to flow to the circulation flow path 3, may be defined as a through-hole defined to extend through the connection body 177.

The second support 19A may include a second fixed body 191 fixed inside the cabinet 1A, and a second support body 195 disposed on the second fixed body 191 and inserted into a rear face (a second open face) of the drum body 21A. The second support 19 includes an air inlet 198 defined to extend through the second fixed body 191 to allow an interior of the drum body 21 and an interior of the drying cabinet 1A to communicate with each other. In this case, a duct 3A may be constructed to connect the air outlet 178 and the air inlet 198 to each other.

The cylindrical drum body 21A with an empty interior may be rotated by various types of drying drivers. A case in which the drying driver 82, 83, 85 includes a motor 82 fixed inside the drying cabinet 1A, a pulley 85 rotated by the motor, and a belt 83 that connects a circumferential face of the pulley 85 and a circumferential face of the drum body 21A to each other is shown as an example.

In one example, the drying driver may be disposed on a rear face of the drying drum 2A to directly rotate the drum 2A. A rotation shaft of the drying driver 82, 83, 85 may be directly coupled to the drum 2A to rotate the drying drum 2A.

In this case, the second support 19A may support the drying driver 82, 83, 85 to be located on a rear face or at a center of the drying drum 2A.

In one example, a separate reducer may be disposed between the drying driver 82, 83, 85 and the drying drum 2A. In this case, a rotation shaft from the reducer may be directly coupled to a center of the rear face of the drum 2A, and the reducer may be coupled to and supported by the second support 19.

In this regard, the drying driver 82, 83, 85 may freely change a rotation speed and a rotation direction of the drum 2A.

The first support 17 may have a first roller 179 that rotatably supports the circumferential face of the drum body 21A, and the second support 19 may have a second roller 199 that rotatably supports the circumferential face of the drum body.

The circulation flow path 3A may include a duct in communication with the drum 2. The duct 3A may be in communication with the drying drum 2A, so that it may be considered that the duct 3A forms a circulation flow path in which air discharged from the drying drum passes the heat exchanger 4 and is re-introduced into the drum 2A.

The duct 3A may include an exhaust duct 31A connected to the air outlet 178, a supply duct 33A connected to the air inlet 198, and a connection duct 35A that connects the exhaust duct and the supply duct to each other.

The heat exchanger 4 may be formed as various apparatuses as long as the dehumidification and the heating of air introduced into the duct 3A may be sequentially performed. For example, the heat exchanger 4 may be formed as a heat pump system.

The heat exchanger 4 may include a fan 49 that allows air to flow along the duct 3A, a first heat exchanger (a heat absorber) 41 that removes moisture from air introduced into the duct 3A, and a second heat exchanger (a heater) 43 that is disposed inside the duct 3A to heat air that has passed through the first heat exchanger 41.

The heat absorber 41 may be formed as an evaporator that absorbs heat, and the heater 43 may be formed as a condenser that emits heat.

Figure 4:
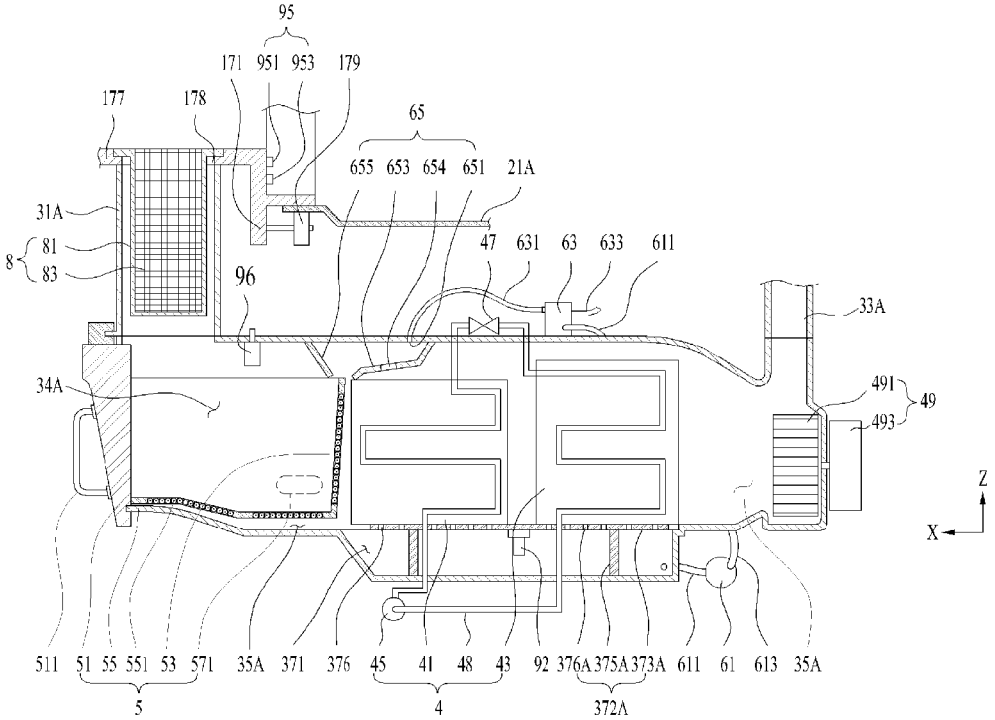

The fan 49 may include an impeller 491 disposed inside the duct 3A, and an impeller motor 493 that rotates the impeller 491 (see FIG. 4). The impeller 491 may be disposed in any of the exhaust duct 31A, the connection duct 35A, and the supply duct 33A. The impeller 491 may be disposed in the supply duct 33A.

The heat absorber 41 is formed with multiple metal plates disposed along a width direction (a Y-axis direction) of the connection duct 35A or a height direction (a Z-axis direction) of the connection duct, and the heater 43 may be formed with multiple metal plates disposed along the width direction of the connection duct or the height direction of the connection duct. The heat absorber 41 and the heater 43 are sequentially arranged inside the connection duct 35A in a direction from the exhaust duct 31A toward the supply duct 33A, and are connected to each other via a refrigerant pipe 48 that forms a circulation flow path of a refrigerant.

The refrigerant moves along the refrigerant pipe 48 by a compressor 45 located outside the duct 3A, and the refrigerant pipe 48 has a pressure regulator 47 that adjusts a pressure of the refrigerant that has passed through the heater 43.

The heat absorber 41 is means for cooling air and evaporating the refrigerant by transferring the heat of air introduced into the exhaust duct 31A to the refrigerant. The heater 43 is means for heating air and condensing the refrigerant by transferring the heat of the refrigerant that has passed through the compressor 45 to air. In this case, the moisture contained in air will be collected on a bottom face of the connection duct 35A along a surface of the heat absorber 41 when passing through the heat absorber 41.

In order to collect water removed from air passing through the heat absorber 41, the laundry drying apparatus 20 has a water collecting portion.

The water collected in the water collecting portion may be collected in a water storage 7 and discharged all at once later. The water storage 7 may include a water storage tank 72 that is detachably disposed in the cabinet 1 to provide a space for storing water, and an inlet 722 defined to extend through the water storage tank 72 to introduce water discharged from a water storage supply pipe 633 into the water storage tank 72.

The water storage tank 72 may be formed as a tank in a form of a drawer extended from the cabinet 1. In this case, the front panel 11A of the cabinet must have a water storage mounting hole or tank hole into which the water storage tank 72 is inserted. A water storage panel 71 is fixed to a front face of the water storage tank 72. The water storage panel 71 may be detachably coupled to the water storage mounting hole or tank hole 115 to form a portion of the front panel 11A.

The water storage panel 71 may further include a groove 711 into which a user's hand is inserted. In this case, the water storage panel 71 will also perform a function of a handle for extending or retracting the water storage tank 72 from or into the cabinet.

The inlet 722 may be defined to receive water discharged from a nozzle 722*a* fixed to the drying cabinet 1A. The nozzle 722*a* may be fixed to a top panel 13 of the cabinet so as to be positioned above the inlet 722 when the storage body 72 is inserted into the cabinet 1.

In the water storage 7 having the above structure, the user may discard water inside the water storage tank 72 by extending the water storage tank 72 from the cabinet 1 and then inverting or tilting the water storage tank 72 in a direction in which the inlet 722 is directed. A communication hole 721 defined to extend through a top face of the storage body 72 may be further defined such that water inside the water storage tank 72 is easily discharged through the inlet 722.

In one example, the heat exchanger 4 is constructed to condense the moisture in air circulating in the heat absorber 41. Therefore, even when the air circulates in the drum 2A, the moisture is removed by the heat absorber 41, so that the laundry inside the drum 2A may be continuously dried.

The moisture condensed in the heat absorber 41 may be first collected in the water collecting portion 37A and then collected secondary in the water storage 7. The water collecting portion 37A may be located inside the connection duct 35, and may be separately disposed in a space spaced apart from the connection duct 35.

FIG. 4 shows a detailed structure of the water collecting portion 37A, the heat exchanger 4, and a washer 6.

The water collecting portion 37A may be formed as a water collecting body 371A fixed to a bottom face of the connection duct 35A and in communication with the interior of the connection duct. A heat exchanger support 372A may be further disposed inside the water collecting body 371A such that the heat absorber 41 and the heater 43 do not come into contact with water (condensed water) stored in the water collecting body 371A. The heat exchanger support 372A may include a support plate 373A in contact with the heat absorber 41 and the heater 43, a spacer 375A that maintains a gap between the support plate 373 and a bottom face of the water collecting body 371A, and a support plate through-hole 376A defined to extend through the support plate 373A.

The support plate through-hole 376A may be defined only in a space in which the heat absorber 41 is supported of the space provided by the support plate 373A, and may be defined in each of the space in which the heat absorber is supported and a space in which the heater is supported. When the support plate through-hole 376A is also defined in a bottom face of the heater 43, water flowed to the heater 43 along the support plate 373A may be discharged to the water collecting portion 371A (to prevent a decrease in heat transfer efficiency that occurs when the heater comes into contact water).

In order to minimize the foreign substances (lint and the like) discharged from the drying drum body 21A being stacked in the heat absorber 41 and the heater 43, the laundry drying apparatus 20 may further include filtration means for filtering air.

Second filtration means 8 may be formed as means for filtering air introduced into the exhaust duct 31A from the drying drum body 21A, and first filtration means 5 may be located between the second filtration means 8 and the heat absorber 41 and be formed as means for filtering air that has passed through the second filtration means. A diameter of a filtration hole defined in the first filtration means 5 may be set smaller than a diameter of a filtration hole defined in the second filtration means 8.

The second filtration means 8 may include a frame 81 that is detachably inserted into the exhaust duct 31A through the air outlet 178, and a filter (a fourth filter) 83 disposed in the frame to filter air.

The first filtration means 5 may be detachably disposed in the connection duct 35. In this case, the front panel 11 of the cabinet may have a filter mounting hole from which the first filtration means 5 is withdrawn and a mounting hole door that opens and closes the filter mounting hole, and the duct 3A may have a duct through-hole 34 (see FIG. 3) into which the first filtration means 5 is inserted. Accordingly, the user may remove the foreign substances remaining in the first filtration means 5 and wash the first filtration means after separating the first filtration means 5 from the laundry treating apparatus as needed.

The first filtration means 5 may include a filtration means body 51, 53, and 55 inserted into the filter mounting hole and the duct through-hole 34 and positioned between the second filtration means 8 and the heat absorber 41, and filters 531, 551, and 571 disposed in the filtration means body to filter fluid (air and water) flowing to the heat absorber 41 and the water collecting portion 371A.

The filtration means body may be formed in various forms depending on a shape of a cross-section (a Y-Z plane and a X-Z plane) of the connection duct 35A. FIG. 1 shows an example of a case in which the filtration means body is formed in a shape similar to a hexahedron.

In this case, the filtration means body may include a front face 51 formed in a shape capable of closing the duct through-hole 34, a rear face 53 positioned between the front face and the heat absorber 41, a bottom face 55 constructed to connect the front face and the rear face with each other, and a first side face 57 and a second side face 58 that form a left side face and a right side face of the filtration means body.

The front face 51 may have a lock 511 removably coupled to a lock fastening portion 16 disposed in the cabinet. The lock 511 may be formed as a bar rotatably coupled to the front face 51 of the filtration means body, and the lock fastening portion may define a groove in which a free end of the bar is accommodated. Preferably, the locks 511 are respectively disposed on opposite sides of the front face 51, and the lock fastening portions 16 are respectively disposed on opposite sides of the filter mounting hole.

To facilitate insertion of the filtration means body into the connection duct 35A or removal of the filtration means from the connection duct 35A, the front face 51 may further include a handle 511.

The rear face 53 and the bottom face 55 may respectively have a first filter 531 and a second filter 551 for filtering the fluid (air and water) introduced into the filtration means body. The rear face 53 has a rear face through-hole defined therein for allowing an interior of the filtration means body and the internal space of the duct 3A to be in communication with each other, and the first filter 531 is disposed in the rear face through-hole. The bottom face 55 has a bottom face through-hole for allowing the interior of the filtration means body and the internal space of the duct 3A to be in communication with each other, and the second filter 551 is disposed in the bottom face through-hole. Therefore, the first filter 531 is means for filtering the fluid (air and water) supplied to the heat absorber 41, and the second filter 551 is means for filtering the fluid supplied to the water collecting portion 371A.

The first side face 57 and the second side face 58 may be constructed to connect the front face 51, the rear face 53, and the bottom face 55 to each other.

The first filtration means 5 having the above structure may be in communication with the exhaust duct 31A through the top face or the second side face 58 of the filtration means body. FIG. 1 shows a case in which the first filtration means 5 is connected to the exhaust duct 31A through a top face through-hole defined to extend through the top face of the filtration means body and a side face through-hole defined to extend through the second side face 58 as an example.

The first filter 531 may be inclined in an angle range from 90 degrees to 100 degrees toward a front face of the heat absorber 41 based on the bottom face 55 of the filtration means body. This is to allow the foreign substances remaining in the first filter to easily move to the bottom face 55 when water is injected into the first filter 531 via the washer 6 to be described later.

The second filter 551 may be inclined downward in an angle range from 10 to 20 degrees from the front face 51 toward the first filter 531 (The second filter may be inclined upward in an angle range from 10 to 20 degrees in a direction from a lower end of the first filter to the filter mounting hole). When the second filter 551 is inclined downward toward the first filter 531, because a connection point of the first filter 531 and the second filter 551 will be the lowest point in the space provided by the first filtration means, the foreign substances of the first filtration means 5 may be concentrated at the connection point of the first filter 531 and the second filter 551. When the foreign substances are concentrated at the connection point of the first filter 531 and the second filter 551, the user will be able to more easily remove the foreign substances inside the first filtration means 5.

However, when the foreign substances are concentrated at the connection point of the first filter 531 and the second filter 551, there may be a situation in which a long time is required for water sprayed via the washer 6 to be discharged to the water collecting portion 371. In order to solve such problem, a bypass hole for allowing the interior of the first filtration means 5 and the water collecting portion 371 to be in communication with each other, and a third filter 571 disposed in the bypass hole may be further disposed.

The bypass hole and the third filter 571 may be defined at a position higher than an uppermost end of the second filter 551 and lower than an uppermost end of the first filter 531. Therefore, the laundry treating apparatus may minimize a phenomenon in which water sprayed to the first filtration means 5 is not able to be recovered at the water collecting portion 371 by the foreign substances remaining in the first filtration means 5.

In one example, the laundry drying apparatus 20 may further include the washer 6 that washes the first filtration means 5 using water stored in the water collecting portion 371A. That is, water stored in the water collecting portion 371A may be separately collected into the water storage 7 or may be selectively flowed to the washer 6.

The washer 6 may be formed as means for washing at least one of the first filter 531, the second filter 551, the third filter 571, and the heat absorbers 41 by spraying water stored in the water collecting portion 371A to the first filtration means 5. The washer 6 may include a spray 65 disposed in the duct 3A to supply water to the first filtration means 5, and a washing pump 61 that allows water stored in the water collecting portion 371A to flow to the spray 65.

The washing pump 61 may be connected to the water collecting portion 371A via a first connection pipe 611, and may be connected to the spray 65 via a second connection pipe 613. When the laundry treating apparatus is constructed to allow water of the water collecting portion 371A to flow to the spraying portion 65 and the water storage 7 with only one washing pump 61, the laundry drying apparatus 20 may further include flow path switching portion 63. In this case, the flow path switching portion 63 may be connected to the washing pump 61 via the second connection pipe 613, the spray 65 may be connected to the flow path switching portion 63 via a spray supply pipe 631, and the water storage 7 may be connected to the flow path switching portion 63 via the water storage supply pipe 633.

In this case, the water storage supply pipe 633 should connect the nozzle 722*a* and the flow path switching portion 63 to each other.

The flow path switching portion 63 includes a valve for controlling opening and closing of the spray supply pipe 631 and opening and closing of the water storage supply pipe 633. Therefore, the laundry drying apparatus 20 may control the valve disposed in the flow path switching portion 63 to supply water stored in the water collecting portion 371A to the spray 65 or to the water storage 7.

A case in which the spray 65 includes a duct through-hole 651 defined to extent through the connection duct 35 and to which the spray supply pipe 631 is connected, a first guide 653 that guides water supplied from the duct through-hole to the first filter 531, and a second guide 655 that guides at least a portion of water supplied through the first guide 653 to the front face of the heat absorber 41 is shown as an example. In this case, the second guide 655 may be disposed as means for allowing water to be supplied to the front face of the heat absorber 41 via the first filter 531. That is, the first filter 531 may be disposed between the first guide 653 and the second guide 655 when the first filtration means 5 is fixed to the connection duct 35A, and the second guide 655 may be formed as an inclined face inclined downward toward the first filter 531 from a top face of the connection duct 35.

The first guide 653 may further include a guide through-hole 654. The guide through-hole 654, as a hole defined to extend through the first guide 653, may allow water introduced into the duct through-hole 651 to be supplied to a front area of the heat absorber 41 through the guide through-hole 654. The front area of the heat absorber means an area positioned at a side facing toward the first filter 531 based on a vertical line passing through a center of the heat absorber 41.

In one example, it is preferable that the laundry treating apparatus of the present disclosure includes water collecting portion water level sensing means 92 that measures a water level of the water collecting portion 371A and transmits the water level to the controller. When the water collecting portion water level sensing means 92 is disposed, the laundry treating apparatus may determine a time point of allowing water stored in the water collecting portion 371A to flow to the storage body 72. Therefore, water of the water collecting portion 371A may be prevented from flowing back into the connection duct 35A.

The water collecting portion water level sensing means 92 may be formed as any device capable of sensing the water level inside the water collecting portion 371A. FIG. 3 shows a sensor with multiple electrodes having different lengths (multiple electrodes electrically connected based on the water level) as an example.

The laundry drying apparatus 20 may have dryness sensing means to determine a time point to stop operation of the heat exchanger 4 by determining a dryness of the laundry. The dryness sensing means may be formed as at least one of an electrode sensor 95 constructed to be in contact with the laundry to measure an amount of moisture contained in the laundry, and a humidity sensor for measuring humidity of air introduced into the duct 3A from the drum 3.

The electrode sensor may include a first electrode 951 and a second electrode 953 that may be fixed to the first fixed body 171 and may be in contact with the laundry inside the drum body 21A. As the dryness increases, the amount of moisture contained in the laundry will decrease (an electrical resistance of the laundry will increase), so that the laundry drying apparatus 20 may determine the dryness of the laundry by observing an electrical resistance measured when the two electrodes 951 and 953 are connected to each other via the laundry. In one example, as the dryness of the laundry increases, the amount of moisture contained in air introduced into the duct 3A will decrease, so that the laundry drying apparatus 20 may determine the dryness of the laundry by observing the humidity of air introduced into the duct 3A via the humidity sensor.

In addition, the laundry drying apparatus 20 may further include temperature sensing means 96 for measuring a temperature of air introduced into the duct 3A. The temperature sensing means 96 may be fixed to the top face of the connection duct 35A and positioned between the first filter 531 and the second filter 551.

Figure 5:
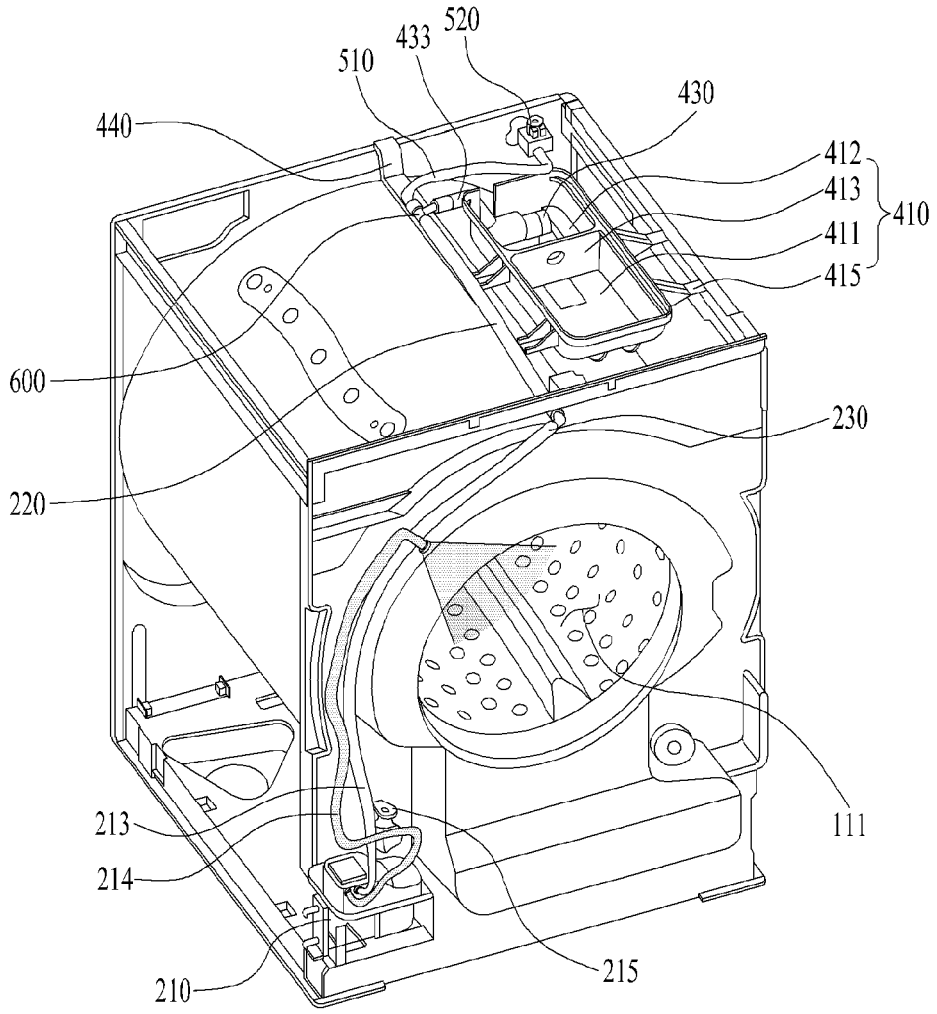
FIG. 5 shows an embodiment of an internal structure of a laundry dry apparatus 20 of the present disclosure.

FIG. 5 shows an embodiment of an internal structure of the laundry dry apparatus 20 of the present disclosure.

The driver 28 may be directly fastened to a rear face of the drying drum 2A. The drying driver 28 may be disposed on the second support 19 to directly rotate the drying drum 2A.

The drying driver 28 may include a stator supported by the second support 19, a rotor rotated by the stator, and a rotation shaft.

The drying driver 28 may be separately coupled to a reducer 28A, and the reducer 28A may be coupled to a center (a rotation center) of a rear face of the drying drum 2A to rotate the drying drum 2A.

Accordingly, the reducer 28A may increase a torque while reducing an RPM of the rotation shaft.

The steam apparatus 200 may be disposed to be fixed to the front panel 11 or the first support supporting the drum 2 for space utilization. In addition, the steam apparatus 200 may be disposed adjacent to a corner of the cabinet 1.

The internal supply 400 may include a water tank 420 for storing water, a water pump 430 for supplying power for supplying the water stored in the water tank 420 to the steam apparatus 200, and a tank housing 410 that provides a space in which the water pump 430 and the water tank 420 are installed.

The tank housing 410 may be formed in a box shape with an open top face, and may extend along a front and rear direction of the cabinet 1 such that the water tank 420 may be disposed in a front portion of the cabinet 1 and the water pump 430 may be disposed in a rear portion of the cabinet 1.

The tank housing 410 may include a tank mounting portion 411 in which the water tank 420 is detachably mounted, and a pump mounting portion 412 in which the water pump 430 may be mounted. The tank mounting portion 411 and the pump mounting portion 412 may be formed in a recessed shape to prevent water leaking from the water tank 420 or the water pump 430 from leaking to the drying drum 2A or the like.

In addition, the tank housing 410 may further include a partition wall 413 partitioning the tank mounting portion 411 and the pump mounting portion 412 from each other. Accordingly, the water tank 420 may be easily mounted in and detached from the tank housing 410. The partition wall 413 may also serve to collect residual water in the tank mounting portion 411 or residual water in the pump mounting portion 412 such that the residual water does not flow to another place.

An extension pipe 416 for allowing the water tank 420 and the water pump 430 to be in communication with each other may be installed in the partition wall 413. A valve structure may be installed on the extension pipe 416 to prevent leakage of water even when the water tank 420 is removed from the tank mounting portion 411.

The extension pipe 416 may extend from the partition wall 413 toward the water pump 430 or toward the water tank 420.

In one example, the tank housing 410 may be formed such that the pump mounting portion 412 is disposed closer to the steam apparatus 200 than the tank mounting portion 411. Accordingly, a flow path from the water tank 420 to the steam apparatus 200 may become simplified.

The tank housing 410 may be formed such that the tank mounting portion 411 and the pump mounting portion 412 are arranged along a front and rear direction of the cabinet.

The water supply 300 may include a coupling portion capable of fixing the tank housing 410 to at least one of the support bar 440 and one side face of the cabinet.

A rotating drying drum 2A is disposed inside the drying cabinet 1. Accordingly, the components arranged inside the cabinet 1 need to be spaced apart from the drying drum 2A. Therefore, it is necessary to prevent the water supply 300 and the steam apparatus 200 from coming into contact with the drum 2. For example, a steam guide pipe 230 for supplying steam from the steam apparatus 200 to the drum 2, the direct water pipe 510 for supplying water to the steam apparatus 200, or the like needs to be blocked from coming into contact with the drying drum 2A.

It is necessary to support not only the water tank 420 and the water pump 430 but also a load of water accommodated in the water tank 420.

Therefore, the laundry treating apparatus of the present disclosure may include a support bar 440 for supporting the steam apparatus 200 and the water supply 300 to prevent the steam apparatus 200 and the water supply 300 from coming into contact with the drum, and supporting the steam apparatus 200 and the water supply 300 inside the drying cabinet.

The support bar 440 may be constructed to support at least a portion of the steam apparatus 200 or at least a portion of the water supply 300. In addition, the support bar 440 may fix or support the tank housing 410 to the drying cabinet.

The support bar 440 may be formed in a shape of a bar having both ends respectively coupled to the drying front panel 11 and the drying rear panel 12. Accordingly, the support bar 440 may support a load of the tank housing 410 as well as fix the drying front panel 11 and the drying rear panel 12. The support bar 440 may be spaced apart from the drying side panel 14 by a predetermined distance and coupled to the drying front panel 11 and the drying rear panel 12. In one example, the both ends of the support bar 440 may be coupled to the cabinet 1, but remaining portion thereof may be disposed at a lower position than an upper portion of the side face of the cabinet 1. Accordingly, the support bar 440 may be spaced apart from the top panel 13 to prevent interference with the top panel 13. In addition, a space capable of supporting some components of the water supply 300 and the steam apparatus 200 may be defined between the support bar 440 and the top panel 13.

An excessive extension of a width of the tank housing 410 may be prevented by the support bar 440.

In one example, although not shown, the tank housing 410 may further include a mounting sensor capable of sensing mounting of the water tank 420 on an inner face thereof. The mounting sensor may be formed as a weight sensor, and may be configured to distinguish whether the weight is small or great.

The mounting sensor may be connected to the drying control panel PA to transmit information on whether the water tank 420 is mounted and an amount of water accommodated in the water tank 420.

The internal supply 400 may include a pump discharge pipe 433 for discharging water from the pump housing 430 to the steam apparatus 200.

The external supply 500 may include a direct water valve 520 seated on the second support 19A or the drying rear panel 12, and a direct water pipe 510 constructed to supply water from the direct water valve 520 to the steam apparatus 200.

The direct water pipe 510 may extend from the drying rear panel 12 to the steam apparatus 200, and the direct water valve 520 may be constructed to open and close the direct water pipe 510. The direct water pipe 510 may extend from the direct water valve 520 to the steam generator 210 across the support bar 440. In this regard, at least a portion of the direct water pipe 510 may be supported by the support bar 440 to prevent contact with the drying drum 2A.

The support bar 440 may be disposed between the direct water valve 520 and the water tank 430.

In addition, the direct water valve 520 may be seated on the drying rear panel 12 or the second support 19A to be exposed to the outside, and the direct water pipe 510 may extend from the direct water valve 520 toward the steam apparatus 200. Accordingly, the external supply 500 may supply water to the steam apparatus 200 in a direct water scheme from an external water supply source.

The steam apparatus 200 may receive water from each of the external supply 500 and the internal supply 400. However, when the steam apparatus 200 is constructed to receive water through respective pipes, a separate shape of the steam apparatus 200 must be manufactured, so that a flow path and a control method may become complicated.

To this end, the laundry treating apparatus of the present disclosure may further include a combining portion 600 for coupling the direct water pipe 510 with the pump discharge pipe 433. The combining portion 600 may be constructed such that both the water stored in the internal supply 400 and the water supplied in the direct water scheme from the external supply 500 are collected.

In addition, the combining portion 600 may be constructed to deliver the supplied water to the steam apparatus 200. The combining portion 600 may be formed as a three-way valve, or may be formed in a shape of a combining pipe in which three pipes are coupled to each other.

When the combining portion 600 is formed in the pipe shape, a check valve may be disposed in each of the external supply 500 and the internal supply 400 to prevent backflow. Specifically, a direct water check valve 511 for opening the direct water pipe 510 in one direction may be installed on the direct water pipe 510, and the pump discharge pipe 433 may have a discharge check valve 434 for opening the pump discharge pipe 433 in one direction.

In addition, the check valves may be disposed on the pump discharge pipe 433 and the direct water pipe 510, respectively. The external supply 500 may include an external check valve, and the internal supply 400 may include an internal check valve.

Accordingly, the water supplied to the direct water pipe 510 may be prevented from flowing back to the water pump 430, and the water supplied to the pump discharge pipe 433 may be prevented from flowing back to the direct water valve 510.

In one example, the combining portion 600 has a significant weight when formed as the valve or the combining pipe. In addition, when water passes through the combining portion 600, a considerable weight may be applied to the combining portion 600.

Accordingly, the combining portion 600 may be seated on the support bar 440.

The combining portion 600 and the support bar 400 may be coupled with each other using a separate fixing member to prevent the combining portion 600 from being separated from the support bar 400. Because the combining portion 600 is seated on the support bar 400, positions of the direct water pipe 510 and the pump discharge pipe 433 may also be stably fixed.

In one example, the steam apparatus 200 may include a water guide pipe 220 connected to the combining portion 600 to receive water from the water supply 300, a steam generator 210 that receives water from the water guide pipe 220 to generate steam, and a steam guide pipe 230 capable of guiding the steam generated by the steam generator 210 to the drying drum 2A or the duct 3A.

The steam generator 210 may be disposed below the drying drum 2A to stably receive water from the water supply 300 by gravity, and the generated steam may be stably moved to the drying drum 2A by a difference in density.

The steam guide pipe 230 may be constructed to be in communication with a gasket disposed on a front face of the drying drum 2A, or the first support. Accordingly, the steam guide pipe 230 may stably supply steam into the drying drum 2A without being in contact with the drying drum 2A.

In one example, the tank housing 410 may have a mounting sensor capable of sensing whether the water tank 420 is mounted. For example, the mounting sensor may be formed as a pressure sensor or the like.

In addition, a water level sensor capable of sensing a water level of the water tank 420 may be further disposed. For example, the water level sensor may be formed as a weight sensor. The mounted sensor or the water level sensor may also be controlled by the control panel 820, and may be configured to transmit a signal to the control panel 820.

In one example, the control panel P may indirectly identify the water level of the water tank 420 by temporarily driving the water pump 430 to sense a load applied to the water pump 430.

The water storage tank 72 may have a significantly larger volume than the water tank 430, and may be disposed to be spaced apart from the water tank 430 in order to prevent confusion of the user between the water storage tank 72 and the water tank 430.

The water tank 430 and the steam apparatus 200 may be disposed between the support bar 440 and one side face of the cabinet, and the water storage tank 72 may be disposed between the support bar 440 and the other side face of the cabinet.

Because the water tank 430 is coupled to the tank mounting portion 411, it may be scen that the tank mounting portion 411 is also disposed between the support bar 440 and one side face of the cabinet.

Consequently, the support bar 440 may be disposed between the water storage tank 72 and the steam generator 210, and may be disposed between the water storage tank 72 and the water tank 430.

Figure 6:
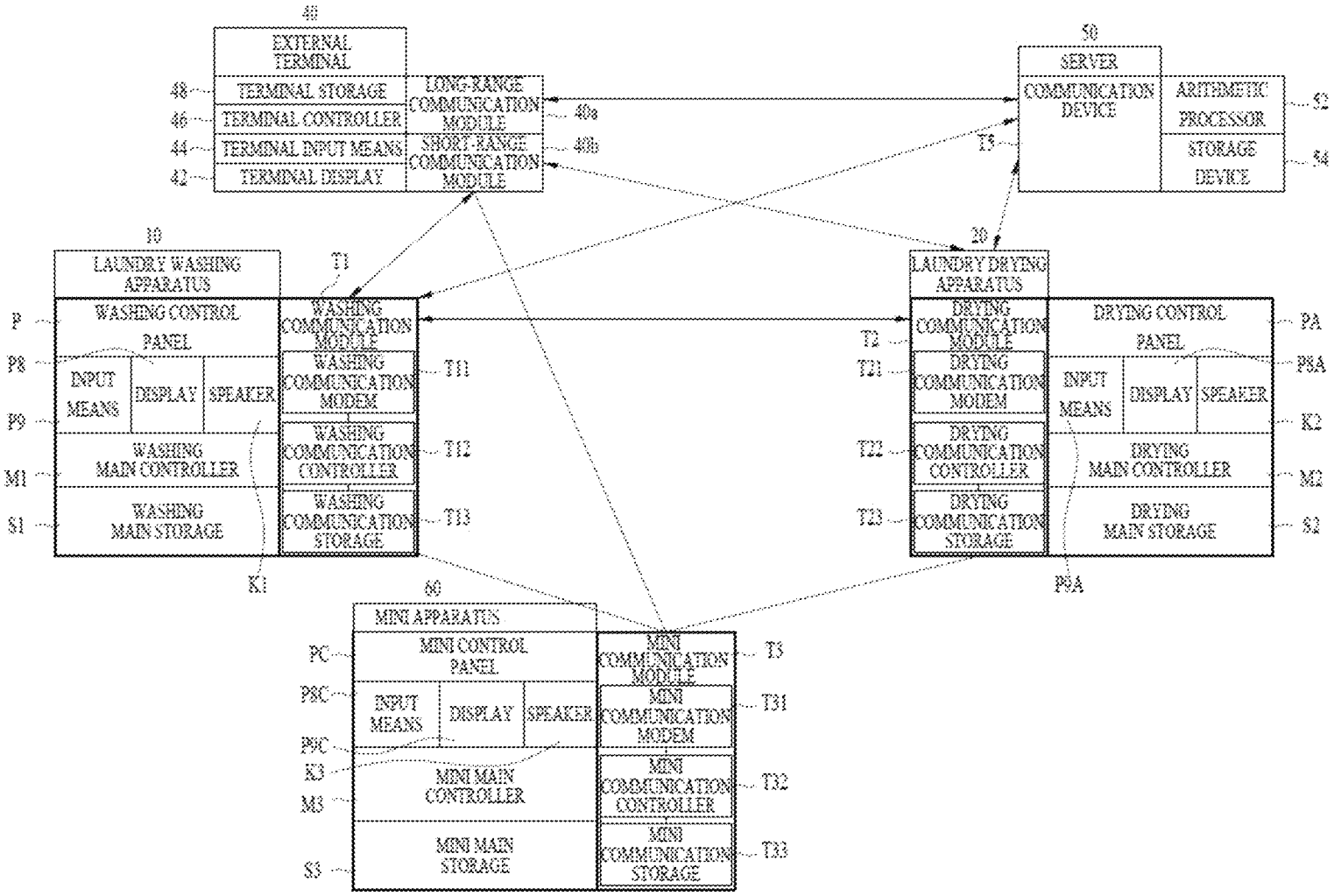
FIG. 6 shows a structure in which, when the laundry treating apparatus includes the laundry washing apparatus 10, the laundry dry apparatus 20, and the auxiliary apparatus 60, the apparatuses may be in communication with each other.

FIG. 6 shows a structure in which, when the laundry treating apparatus includes the laundry washing apparatus 10, the laundry drying apparatus 20, and the mini or mini apparatus 60, the laundry washing apparatus 10, the laundry drying apparatus 20, and the a mini apparatus 60 may be in communication with each other.

The laundry washing apparatus 10 may include a washing control panel P configured to display information and to receive a command from the user.

The washing control panel P may include a displaying portion P8 capable of displaying the state of the laundry washing apparatus 10, an input means P9 capable of inputting the command to the laundry washing apparatus 10, and a washing speaker K1 capable of externally outputting a notification generated from the laundry washing apparatus 10. The laundry washing apparatus 10 may include a controller M1 that may perform the washing course and option including the driver, the water supply, the drainage, and the like of the laundry washing apparatus 10, and may include storage S1 that transmits the information to the controller M1 or stores a program to be used by the controller M1.

The input means P9 may be a concept including all components configured to receive the command of the user for the laundry washing apparatus 10, such as a manipulation portion P47, a power switch P46, an executing portion P47, a setting portion P2, and the like to be described later.

In addition, the laundry washing apparatus 10 may include a washing communication module T1. The washing communication module T1 may include a washing communication modem T11 including means of communication such as Wi-Fi or Bluetooth, a washing communication controller T12 configured to control the communication modem, and washing communication storage T13 that may transmit the received information to the controller M1 or may store a program for controlling the washing communication controller T12 when power to the washing controller M1 is cut off.

The washing communication module T1 may be configured to continuously receive the power even in a state in which power supply to the control panel P of the laundry washing apparatus 10 is cut off, and may be configured to maintain a state in communication with the external terminal 40 and the server 50.

In addition, the washing communication module T1 may be configured to be directly paired with a drying communication module T2 and a mini communication module T31 to be described later to maintain the communication state.

In addition, when the washing communication module T1 receives a power command for supplying power to the control panel p, the power may be controlled to be supplied to the control panel P.

The laundry drying apparatus 20 may include a drying control panel PA configured to display information and to receive a command from the user.

The drying control panel PA may include a drying displaying portion P8A capable of displaying the state of the laundry drying apparatus 20, a drying input means P9A capable of inputting the command to the laundry drying apparatus 20, and a drying speaker K2 capable of externally outputting a notification generated from the laundry drying apparatus 20. The laundry drying apparatus 20 may include a drying controller M2 that may perform the drying course and option of operating the driver and the like, and may include drying storage S2 that transmits the information to the drying controller M1 or stores a program to be used by the drying controller M1.

The drying input means P9A may be a concept including all components configured to receive the command of the user for the laundry washing apparatus 10, such as the manipulation portion P47A, the power switch P46A, the executing portion P47A, the setting portion P2A, and the like to be described later.

In addition, the laundry drying apparatus 20 may include a drying communication module T2. The drying communication module T2 may include a drying communication modem T21 including means of communication such as the Wi-Fi or the Bluetooth, a drying communication controller T22 configured to control the communication modem, and drying communication storage T23 that may transmit the received information to the drying controller M2 or may store a program for controlling the drying communication controller T22 when power to the drying controller M2 is cut off.

The drying communication module T2 may be configured to continuously receive the power even in a state in which power supply to the drying control panel PA of the laundry drying apparatus 20 is cut off, and may be configured to maintain a state in communication with the external terminal 40 and the server 50.

In addition, the drying communication module T2 may be configured to be directly paired with the communication module T1 and the mini communication module T31 to be described later to maintain the communication state.

In addition, when the drying communication module T2 receives a power command for supplying power to the drying control panel PA, the power may be controlled to be supplied to the drying control panel PA.

The mini apparatus 60 may include a mini control panel PC configured to display information and to receive a command from the user.

The mini control panel PC may include a mini displaying portion P8C capable of displaying the state of the mini apparatus 60, a mini input means P9C capable of inputting the command to the mini apparatus 60, and a mini speaker K3 capable of externally outputting a notification generated from the mini apparatus 60. The mini apparatus 60 may include a mini controller M3 that may perform the washing course and option of operating the driver, the water supply, the drainage, and the like of the mini apparatus 60, and may include mini storage S3 that transmits the information to the mini controller M3 or stores a program to be used by the mini controller M3.

The mini input means P9C may be a concept including all components configured to receive the command of the user for the laundry washing apparatus 10, such as the manipulation portion P47C, the power switch P46C, the executing portion P4C, the setting portion P2C, and the like to be described later.

In addition, the mini apparatus 60 may include a mini communication module T3. The mini communication module T3 may include a mini communication modem T31 including means of communication such as the Wi-Fi or the Bluetooth, a mini communication controller T32 configured to control the mini communication modem, and mini communication storage T33 that may transmit the received information to the mini controller M3 or may store a program for controlling the mini communication controller T32 when power to the mini controller M3 is cut off.

The mini communication module T3 may be configured to continuously receive the power even in a state in which power supply to the mini control panel PC of the mini apparatus 60 is cut off, and may be configured to maintain a state in communication with the external terminal 40 and the server 50.

In addition, the mini communication module T3 may be configured to be directly paired with the communication module T1 and the drying communication module T2 to be described later to maintain the communication state.

In addition, when the mini communication module T3 receives a power command for supplying power to the mini control panel PC, the power may be controlled to be supplied to the mini control panel PC.

In one example, the external terminal 40 may include a short-range communication module 40*b* configured to be in direct communication with the laundry washing apparatus 10, the laundry drying apparatus 20, and the mini apparatus 60, and a long-range communication module 40*a* configured to be in communication with the server 50.

In addition, the external terminal 40 may further include a terminal displaying portion 42 for displaying the information received from the communication module, a terminal input means 44 that transmits the command to a home appliance such as the laundry washing apparatus 10 or to the server 50, and a terminal controller 46 for controlling the terminal displaying portion 42, the terminal input means 44, and the communication module. The external terminal 40 may further include terminal storage 48 to store the information received from the communication module or to store a program for controlling the terminal controller 46.

The server 50 may include a communication device T5 capable of being in communication with the external terminal 40, the laundry washing apparatus 10, the laundry drying apparatus 20, and the mini apparatus 60, an arithmetic processor 52 that calculates information received from or to be transmitted to the external terminal 40, the laundry washing apparatus 10, the laundry drying apparatus 20, and the mini apparatus 60, and a storage device 54 in which the information received from the external terminal 40, the laundry washing apparatus 10, the laundry drying apparatus 20, and the mini apparatus 60 may be stored or the arbitrary course or option that may operate the laundry washing apparatus 10, the laundry drying apparatus 20, and the mini apparatus 60 may be stored.

Figure 7:
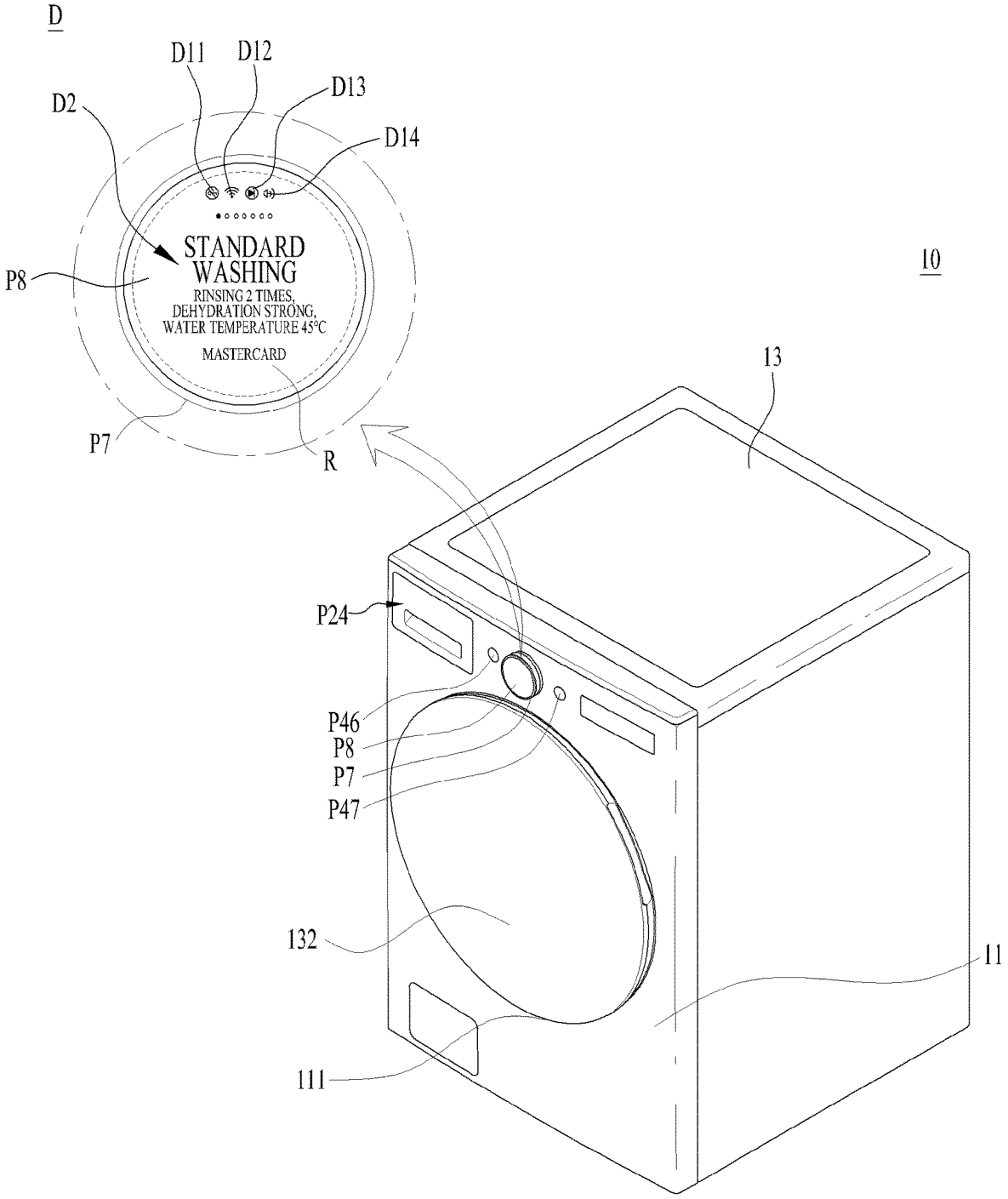
FIG. 7 shows an embodiment of a control panel P that may be applied to a laundry treating apparatus of the present disclosure.

FIG. 7 shows an embodiment of the control panel P that may be applied to the laundry treating apparatus of the present disclosure.

Hereinafter, a description will be made based on the control panel P being disposed in the laundry washing apparatus 10, but the control panel P may be applied to the laundry washing apparatus 10 and the laundry drying apparatus 20 with the same structure and may also be applied to the mini apparatus 60.

In other words, the control panel P, the drying control panel PA, and the mini control panel PC may have the same structure.

The laundry washing apparatus 10 includes the cabinet 1 and the control panel P disposed on the cabinet 1.

The control panel P refers to a device that enables communication between the user and the laundry treating apparatus (including other electronic devices in addition to the laundry treating apparatus). The communication between the user and the laundry treating apparatus means a process in which the user inputs the control command to the laundry treating apparatus and a process in which the laundry treating apparatus transmits the information to the user.

The user may input, via the control panel P, at least one of a power command of supplying or cutting off the power of the laundry treating apparatus, a selection command of selecting the arbitrary course or option that treats the laundry, an execution command of performing the selected course or option, and a stop command of stopping the course or option being performed.

The treatment of the laundry may include the washing cycle of removing the foreign substances of the laundry via water and the detergent, or a drying cycle of drying water contained in the laundry.

The control panel P may display an operation state of the laundry treating apparatus or information of the course or option to the user.

For example, the control panel P may display a state in which at least one of the power command, the selection command, the execution command, the performance command, and the stop command is input. In addition, the control panel P may display error information of displaying a problem situation occurring in the laundry treating apparatus, or guide information of guiding an action to be taken by the user.

The cabinet 1 may include the front panel 11 forming a front face of the cabinet 1, and the top panel 13 coupled to a top face of the front panel 11. The front panel 11 and the top panel 13 may be made of a metal material, and may have a steel plate shape.

The control panel P of the laundry treating apparatus of the present disclosure may be coupled to the front panel 11.

The control panel P may be coupled to a rear face of the front panel 11 and may be partially exposed to a front face of the front panel 11. The front panel 11 may be manufactured as a simple metal plate, and the control panel P may be simply coupled to the rear face of the front panel 11 and be fixed.

Accordingly, the front panel 11 may form a most area of the front face of the cabinet 1. As a result, a sense of unity of the front panel 11 may be strengthened and an aesthetics sensation may be maximized. In addition, a process of manufacturing the front panel 11 may be simplified, and a process of assembling or installing the front panel 11 and the control panel P may be simplified. In addition, a separate component such as a frame for mounting the control panel P on the front panel 11 may be omitted.

The control panel P of the laundry treating apparatus of the present disclosure may include a manipulation portion P7 rotatably coupled to the cabinet, and a displaying portion P8 disposed inside the manipulation portion P7 to display the state of the laundry treating apparatus.

The manipulation portion P7 may be formed in a shape of a rotary knob, and the displaying portion P8 may be formed as a display D including a liquid crystal or the like. It may be seen that the displaying portion P8 and a selection portion R to be described later are included in the manipulation portion P7.

The displaying portion P8 may be entirely formed as a touch panel, or may be at least partially formed as the touch panel.

The manipulation portion P7 may be configured to rotate to select the arbitrary course or option that may treat the laundry, and the displaying portion P8 may be configured to display a corresponding course or option each time the manipulation portion P7 rotates.

As a result, the control panel P of the laundry treating apparatus of the present disclosure may prevent an arbitrary course or option capable of rotating the drum to be described later from being displayed as characters, guide phrases, and the like in a certain area.

Accordingly, an area or an area ratio occupied by the control panel P in the front panel 11 may be greatly reduced, and the aesthetics sensation may be maximized as no separate characters or guide phrases are attached to the front panel 11.

Figure 11:
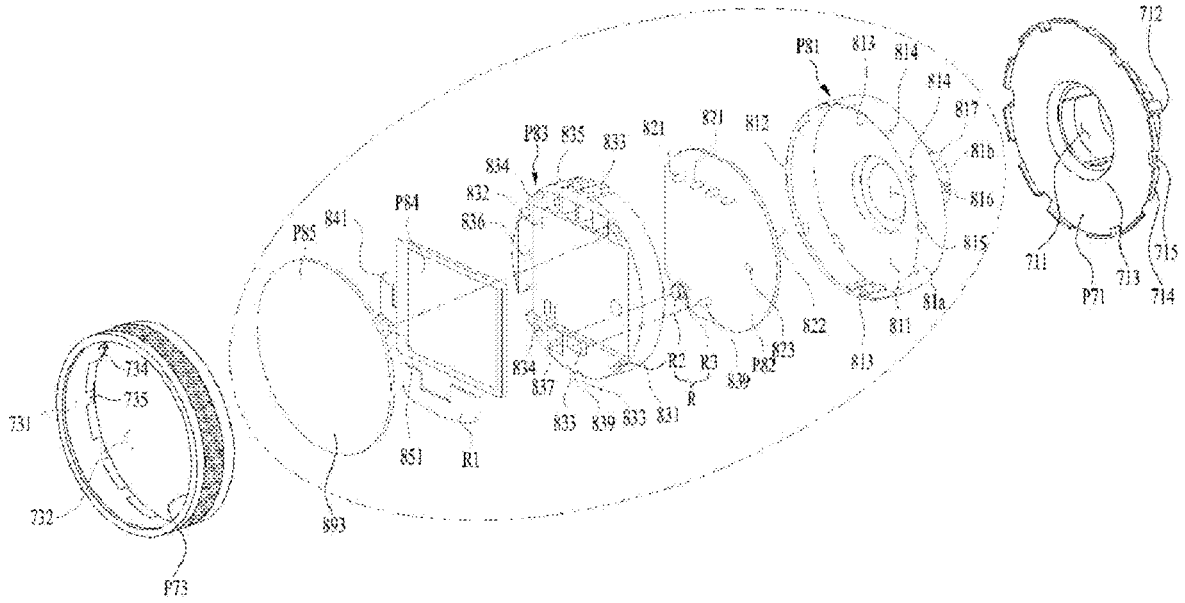
FIG. 11 shows a structure of manipulation portion and a displaying interface.

A display P84 of the displaying portion P8 may include a state display area D1 for displaying the state of the laundry treating apparatus, and a content display area D2 for displaying the state in which the at least one of the power command, the selection command, the execution command, the performance command, and the stop command of the laundry treating apparatus is input, the error information, or the guide information of guiding the action to be taken by the user (see FIG. 11).

The state display area D1 may display a lock state D11 illustrating whether the door 132 is locked to the cabinet, an activation state D12 of the communication module T1, a executed state D13 of the course or the option, and a notification state D14 indicating that there is the notification information for the user.

The content display area D2, as an area displayed with the largest area in the displaying portion P8, may display the selected state, the executed state, the stop state, and the completion state of the course or the option, and may also display states of other home appliances to be described later.

In addition, the control panel P may further include the selection portion R for the user to input a determination command of determining the information to be displayed on the displaying portion P8. The selection portion R may be disposed inside the manipulation portion P7 to further reduce an area occupied by the control panel P.

The selection portion R may be disposed inside the displaying portion P8 and may be disposed spaced apart from the content display area D2. The selection portion R may be formed as a physical button or a touch panel for sensing a contact of a user's body.

The display P84 of the displaying portion may include an input area D3 that may request an input of the selection portion R at a point corresponding to the selection portion R. (see FIG. 11)

The input area D3 may be configured to emit light when the selection portion R may be activated to receive the command from the user.

In one example, the manipulation portion P7 and the displaying portion P8 may be operated only when the power is supplied.

To this end, the control panel P of the laundry treating apparatus of the present disclosure may further include the power switch P46 for inputting the power command to the laundry treating apparatus, as well as the manipulation portion P7 and the displaying portion.

The user may activate the manipulation portion P7 by inputting the power switch P46.

The front panel 11 may include a power switch mounting portion 116 formed such that the power switch P46 may be installed.

In addition, the control panel P may further include the executing portion P47 to which the performance command of performing or stopping the selected course or option is input.

The executing portion P47 may be formed separately from the manipulation portion P7 and the displaying portion P8 to reflect a definite performance or stop intention of the user. In addition, the functions of the manipulation portion P7 and the displaying portion P8 may be prevented from being excessive.

The front panel 11 may include an executing portion mounting portion 117 formed such that the executing portion P47 may be installed.

Figure 9:
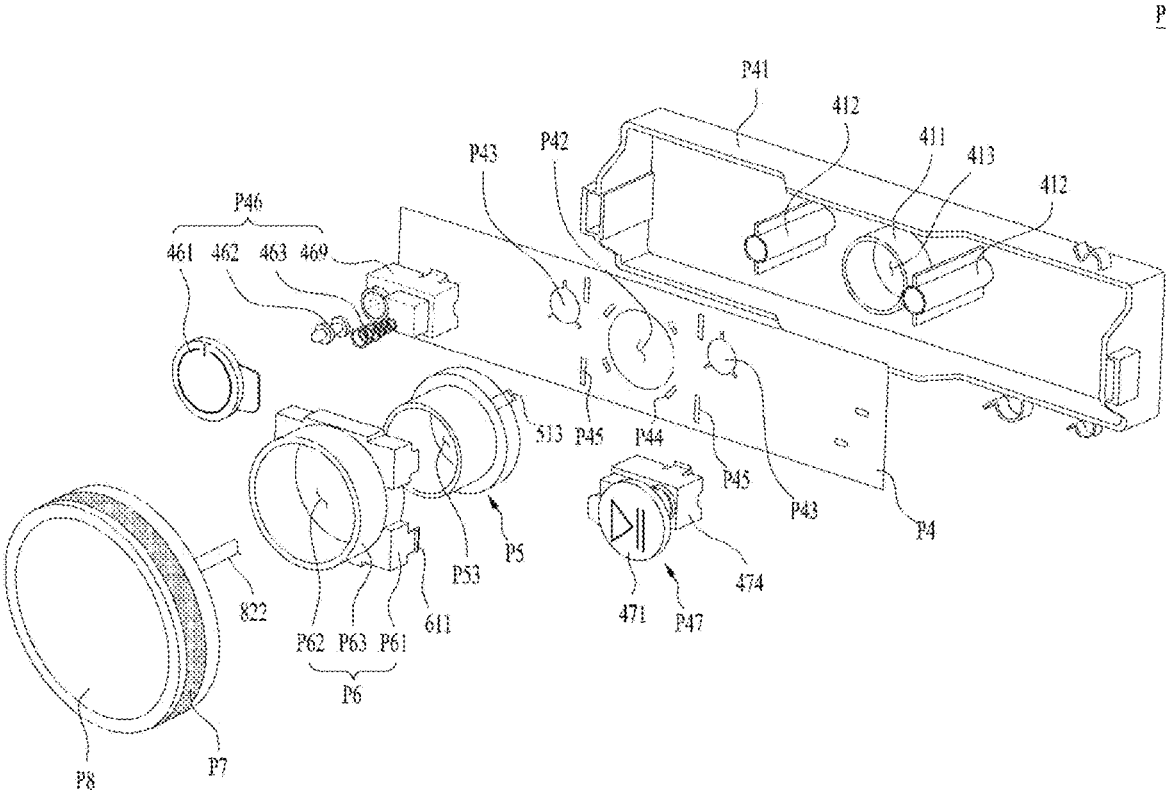
FIG. 9 shows an internal structure of a control panel.

The control panel P may include one control box or casing P41 that may accommodate or install the power switch P46, the execution device P47, the manipulation portion P7, and the displaying portion P8 therein (see FIG. 9).

In one example, the control panel P may further include the setting portion P2 that may add an option to the course or change the option of the course on the front panel 11. The user may set an option capable of changing an intensity, a duration, and the like of the course via the setting portion P2.

The setting portion P2 may be formed separately from the casing P41 and may be coupled to the front panel 11. The setting portion P2 may include a separate liquid crystal and may include a touch panel or a physical button to input the option.

The power switch P46, the executing portion P47, the manipulation portion P7, and the setting portion P2 may be collectively referred to as the input means P9.

In one example, the front panel 11 may have the laundry inlet 111 defined to be in communication with the drum 2, and the door 132 that is pivotably coupled to the cabinet to open and close the laundry inlet 111.

The control panel P may be located above the door 132 to enhance accessibility of the user.

In one example, the front panel 11 may further include locking means L for fixing the door 132 to the front panel 11. When the laundry treating apparatus operates, such as the drum of the laundry treating apparatus rotates, the locking means L may lock the door 132 to the front panel 11. Therefore, a safety accident may be prevented. The locking means L may be unlock the door 132 when the operation of the laundry treating apparatus is completed.

The locking means L may be formed as any component as long as it is able to fix the door 132 to the cabinet 1. The locking means L may be formed as a fastener for fastening a hook protruding from the door, or may be formed as a solenoid valve for holding the hook.

The laundry treating apparatus of the present disclosure may include a detergent box 243 that accommodates therein the detergent for washing the laundry, and the front panel 11 may include a detergent hole P24 from which the detergent box 243 is extended.

The control panel P may be coupled to the front panel 11. As a result, the control panel P may include the input means P9 that receives the control command from the user, and the displaying portion P8 that outputs the information such as the control command selectable by the user.

The main controller M1 for controlling a command for performing the drying operation of the laundry treating apparatus may be installed.

The input means P9 may include a power supply requesting device P46 for requesting the power supply to the laundry treating apparatus, the manipulation portion P7 that enables the user to select a desired course among multiple courses, and the executing portion P47 for requesting start of the course selected by the user.

The displaying portion P8 may include at least one of a display panel capable of outputting text and figures, and a speaker capable of outputting a voice signal and sound.

Figure 8:
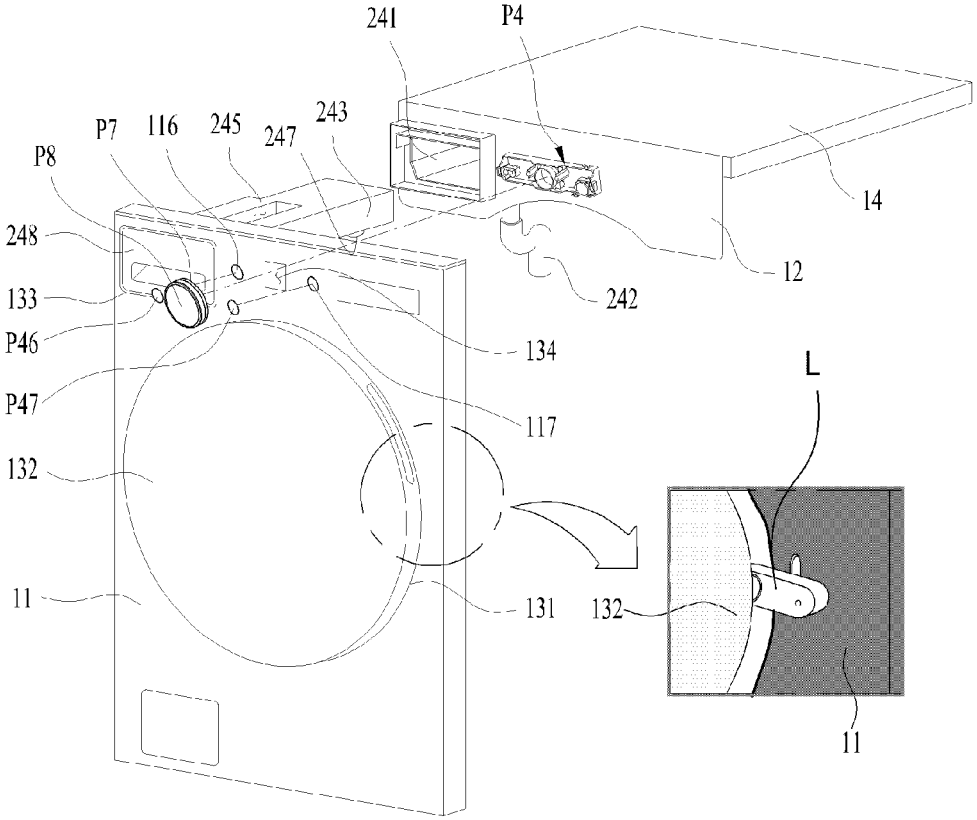
FIG. 8 shows a structure in which a control panel is coupled to a front panel.

FIG. 8 shows a structure in which a control panel is coupled to a front panel.

As shown in the drawing, the laundry washing apparatus 10 may further include a detergent supply P24. The detergent supply P24 may include a detergent box housing 241 disposed inside the cabinet 1, a connecting pipe 242 for connecting the detergent box housing to the tub body 21, and a detergent box 243 that may be extended from the detergent box housing 241 through a detergent box laundry inlet 133 defined in the front panel 11.

The detergent box 243 may include a chamber 245 that provides a space in which the detergent is stored, and a discharge flow path 247 that discharges the detergent inside the chamber to the detergent box housing 241. The discharge flow path 247 may be formed as a water trap (a siphon flow path or the like) that allows liquid to flow to the detergent box housing 241 when a level of the liquid stored in the chamber 245 exceeds a preset water level.

When the detergent supply P24 is disposed in the laundry treating apparatus 10, the water supply 23 may further include a nozzle 232 for supplying water to the chamber 245. The nozzle 232 may be fixed to the cabinet 1 to form a top face of the detergent box housing 241, and the water supply pipe 231 may connect the nozzle 232 and the water supply source to each other.

A detergent box panel 248 may be disposed on a front face of the detergent box 243. The detergent box panel 248 may be formed in a shape to close the detergent box laundry inlet 133, and the detergent box panel 248 may have a detergent box handle.

The front panel 11 may be fixed to the cabinet 1 via a panel support 12. That is, the panel support 12 may be fixed to the cabinet 1, and the front panel 11 may be fixed to the panel support 12. The panel support 12 may have a detergent box through-hole 121 through which the detergent box 243 passes.

The control panel P may be fixed to the cabinet 1 via the panel support 12. The panel support 12 may have an interface mounting groove into which the control panel P is fixed.

The front panel 11 has a first button mounting portion 116 and a second button mounting portion 117. The first button 461 may be exposed to the outside of the cabinet 1 via the first button mounting portion 136, and the second button 471 may be exposed to the outside of the cabinet 1 via the second button mounting portion 117.

The first input means 46 and the second input means 47 may be separately disposed in a left space and a right space of the displaying portion P8, may be separately disposed in an upper space and a lower space of the displaying portion, or may be disposed vertically or horizontally in one of the left space and the right space of the displaying portion.

The cabinet 1 has a panel through-hole 134 defined to extend through the front panel 11. The shaft 71 may be inserted into the panel through-hole 134.

When the laundry treating apparatus is formed as the laundry drying apparatus 20, the rest may be the same except that the component related to the detergent box is changed to the water storage 7.

FIG. 9 shows an internal structure of a control panel.

The control panel P includes a circuit board (a first circuit board) P4 fixed to the panel support 12 and positioned inside the cabinet 1, an encoder P5 fixed to the circuit board and located inside the cabinet 1, the manipulation portion P7 connected to the encoder P5 through the front panel 11, and the displaying portion P8 fixed to the encoder P5 or the first circuit board P4 through the front panel 11.

The first circuit board P4, as a board equipped with a control circuit required for control (power control and operation control) of at least one of the drivers 32, a steam apparatus 200, and the water supply portion 23, the discharge portion 25 may be fixed to the panel support 12 via the casing P41. The casing P41 may have any shape as long as it is able to fix the first circuit board 4 to the panel support 12.

The casing P41 may be formed in a hexahedral shape with one face (a face facing the panel support) open.

A boss for setting a position of the first circuit board P4 may be disposed in the casing P41. The boss may include a first boss 411 and a second boss 412.

In this case, the first circuit board P4 may have a board through-hole P42 through which the first boss 411 passes, and a boss insertion hole P43 through which the second boss 412 passes. The second boss 412 may be disposed in each of left and right spaces of the first boss 411, or may be disposed in each of upper and lower spaces of the first boss 411.

A wire 822 is connected to the displaying portion P8. The wire 822 may be formed as a power line for supplying the power to the displaying portion, or may be formed as a communication line that enables the displaying portion P8 to communicate with devices inside the cabinet including the first circuit board P4.

The first boss 411 may have a first boss through-hole 413 defined therein, and the panel support 12 may have a wire through-hole P42 (see FIG. 4) defined therein. In this case, the wire 822 may be extended into the cabinet 1 by being inserted into the first boss through-hole 413 and the wire through-hole P42.

The first circuit board P4 may further include the power switch P46 and the executing portion P47. The laundry device P46 may be formed as means for inputting the control command for requesting the power supply to the laundry treating apparatus 100, and the executing portion P47 may be formed as means for inputting a command for requesting execution of the control command displayed on the displaying portion P8 or a command for temporarily stopping the control command being executed by the laundry treating apparatus 10.

The power switch P46 and the executing portion P47 may be configured to generate a control signal by sensing static electricity of the user's body.

The power switch P46 may include the first button 461 exposed to the outside of the cabinet 1, a first detection sensor 469 fixed to the first circuit board P4, and a conductor (a first touch spring) 463 for connecting the first button and the first detection sensor to each other. Similarly, the executing portion P47 may include the second button 471 exposed to the outside of the cabinet 1, a second detection sensor 474 fixed to the first circuit board P4, and a conductor (a second touch spring) (not shown) for connecting the second button and the second detection sensor to each other.

The front panel 11 has the first button mounting portion 136 and the second button mounting portion 117. The first button 461 may be exposed to the outside of the cabinet 1 via the first button mounting portion 116, and the second button 471 may be exposed to the outside of the cabinet 1 via the second button mounting portion 117.

The power switch P46 and the executing portion P47 may be separately disposed in the left space and the right space of the displaying portion P8, may be separately disposed in the upper space and the lower space of the displaying portion, or may be disposed vertically or horizontally in one of the left space and the right space of the displaying portion.

The first touch spring 463 and the second touch spring may be formed in a shape of a coil, which is to provide a restoring force to the first button 461 and the second button 471. Furthermore, in order to prevent the first button 461 and the second button 471 from being respectively deviated from the button mounting portions 116 and 117, the power switch 46 may have a first stopper 462 that limits a range of motion of the first button, and the execution device 47 may have a second stopper (not shown) that limits a range of motion of the second button.

The encoder P5 is means for rotatably fixing the manipulation portion P7 to the first circuit board P4, and is means for generating an electrical signal (or generating an electrical signal set differently based on a rotation angle of an actuator) during the rotation of the manipulation portion P7.

The drying control panel PA may have the same structure as the control panel P.

In addition, the mini control panel PC may also have the same structure as the control panel P.

Figure 10:
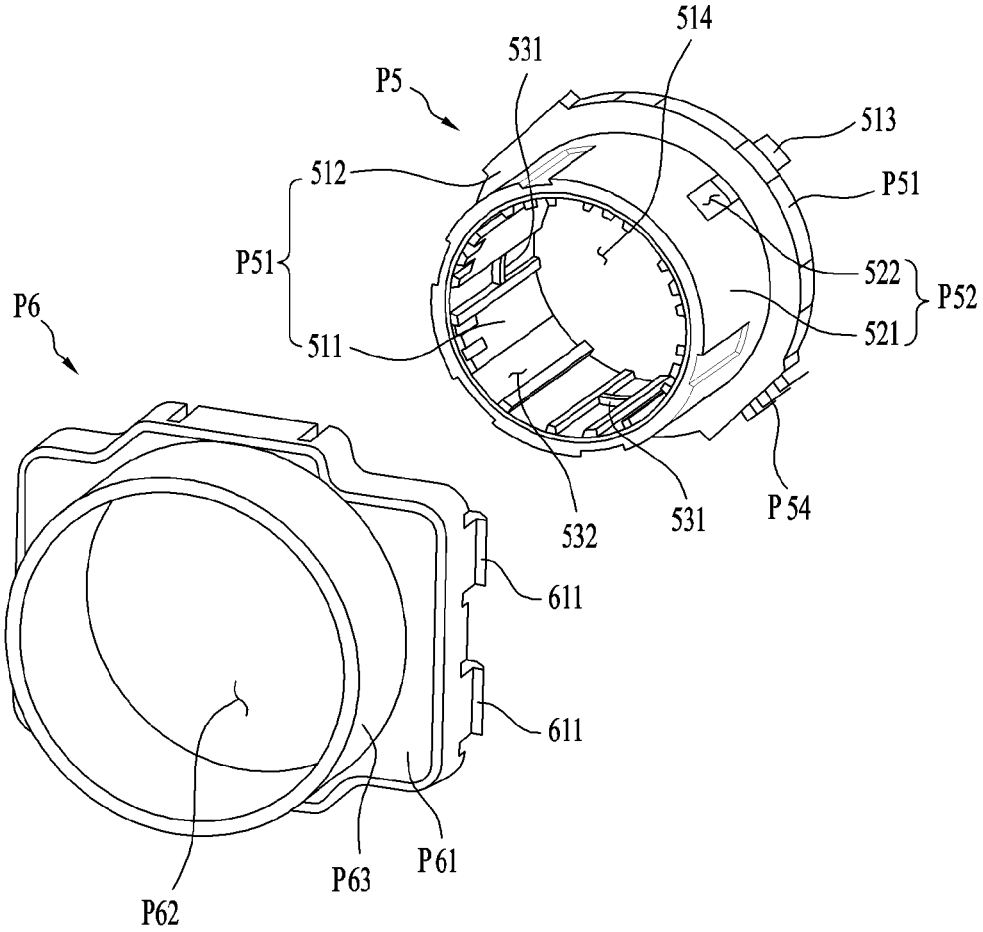
FIG. 10 shows a structure of an encoder.

FIG. 10 shows a structure of an encoder.

The encoder P5 may include a fixed portion P51 fixed to the first circuit board P4 and to which the displaying portion P8 is fixed, a rotating portion P52 rotatably disposed on the fixed portion P51 and to which the manipulation portion P7 is fixed, and a signal generator P54 for generating an electrical signal when the rotating portion P52 is rotated.

The fixed portion P51 may include a fixed body P512 fixed to the first circuit board P4, a support body 511 extending from the fixed body 512 and rotatably fixing the rotating portion P52, and a body through-hole 514 connected to the board through-hole P42 (connected to the first boss through-hole) through the fixed body and the support body.

The fixed body 512 may be formed in a cylindrical shape. A board fastening portion 513 may be disposed on a circumferential face of the fixed body 512 or on one face (a face facing the first circuit board) of the fixed body. In this case, the first circuit board P4 may have an encoder fixing hole P44 defined therein into which the board fastening portion 513 is inserted.

The board fastening portion 513 and the encoder fixing hole P44 may respectively include multiple board fastening portions and multiple encoder fixing holes, and the encoder fixing holes P44 may be arranged to surround the board through-hole P42.

Inside the body through-hole 514, a fastening body fixing portion 531 for fastening the displaying portion P8 to the fixed portion 51, and a position setting groove 532 for preventing the displaying portion 8 from rotating (fixing the position of the displaying portion) when the displaying portion P8 is inserted into the body through-hole 514 may be disposed.

The fastening body fixed portion 531 may be formed as a protrusion protruding toward a center of the body through-hole 514 from at least one of the support body 511 and the fixed body 512. The drawing shows a case in which the fastening body fixed portion 531 is disposed on the support body 511 as an example.

The positioning groove 532 may be defined as a groove in which one face of the fixed portion P51 defining the body through-hole 514 is concavely bent. In this case, the positioning groove 532 may be defined along a longitudinal direction of the body through-hole 514.

The rotating portion P52 may be formed as a rotating body 521 rotatably coupled to the support body 511. The rotating body 521 should have a rotating body through-hole through which the support body 511 passes.

The rotating body 521 may have a shaft fastening portion 522 to which the manipulation portion P7 is fastened. The shaft fastening portion 522 may be formed as a fastening hole extending through a circumferential face of the rotating body 521, or may be formed as a fastening groove defined as the circumferential face of the rotating body 521 is concavely bent.

The signal generator P54 may include a magnet fixed to the rotating body 521, a sensor that is disposed on the fixed body 512 or the support body 511 to sense a magnetic force, and a terminal that connects the sensor and the first circuit board 4 to each other. The magnet may be formed as multiple permanent magnets are arranged to be spaced apart from each other along the circumferential face of the rotating body 521.

The first circuit board P4 to which the encoder P5 is assembled may be coated with an insulating material. This is to minimize a possibility that water is supplied to the first circuit board P4 and the circuit is short-circuited. When the insulating material is coated on one face (a face facing the front panel) of the first circuit board P4, in order to prevent the rotating body 521 from being fixed to the support body 511 by the insulating material, the control panel P may further include an encoder cover P6.

The encoder cover P6 may be formed in a pipe shape that is fixed to the first circuit board P4 and surrounds the encoder P5. That is, as shown in the drawing, the encoder cover P6 may include a fixed body cover P61 that is fixed to the first circuit board P4 and surrounds the fixed body 512, and a cover through-hole P62 defined to extend through the fixed body cover P61 and into which the encoder 5 is inserted.

The fixed body cover P61 may have a board fastening portion 611, and the first circuit board P4 may have an encoder cover fixing hole P45 to which the board fastening portion 611 is fixed. The board fastening portion 611 and the encoder cover fixing hole P45 may respectively include multiple board fastening portions and multiplpe encoder cover fixing holes, and the encoder cover fixing holes P45 may be arranged to surround the board fastening portion 513.

For discharging water introduced into the fixed body cover P61, a cover outlet 612 may be further disposed on a circumferential face of the fixed body cover P61. The cover outlet 612 is preferably located at a lowermost end of the circumferential face of the fixed body cover P61.

In one example, the above-described insulating material is applied to the first circuit board P4 after both the encoder P5 and the encoder cover P6 are coupled to the first circuit board P4, and the insulating material sprayed on a partial area of the first circuit board P4 (an outer space of the encoder cover) flows into the encoder cover P6 through the cover outlet 612. In such a process, in order to block the insulating material from being supplied to the rotating body 521, a distance L1 from the first circuit board to an uppermost end of the fixed body 512 is preferably set to be equal to or greater than a distance L2 from the first circuit board to an uppermost end of the cover outlet 612.

The encoder cover P6 may further include a support body cover P63 extending from the fixed body cover P61 and surrounding the rotating body 521 (surrounding the support body). The support body cover P63 may limit the movement of the manipulation portion P7 in a radial direction of the cover through-hole 62, so that the support body cover P63 may prevent the manipulation portion P7 from being separated from the rotating body 521.

FIG. 11 shows a structure of a manipulation portion and a displaying portion.

The manipulation portion P7 may include a shaft P71 that is fixed to the rotating body 521 through the front panel 11, and a handle P73 fixed to the shaft P71 and positioned outside the cabinet 1.

The cabinet 1 has the panel through-hole 134 defined to extend through the front panel 11. The shaft P71 may be disposed to be inserted into the panel through-hole 134.

The shaft P71 may be formed a pipe having a shaft through-hole 711 defined therein. The rotating body 521 disposed in the encoder is inserted into the shaft through-hole 711, and a rotating body fastening portion 712 disposed on a circumferential face of the shaft P71 and positioned inside the shaft through-hole 711 is coupled to a shaft fastening portion 522 disposed on the rotating body. Accordingly, the shaft P71 is fixed to the rotating body 521 via the rotating body fastening portion 712 and the shaft fastening portion 522.

The handle P73 may be fixed to the shaft P71 so as to be located outside of the cabinet 1, and the user may provide a force required for the rotation of the rotating body 521 to the shaft P71 via the handle P73.

The handle P73 may include an accommodation space 731 defined inside the handle to be in communication with the shaft through-hole 711, and a handle through-hole 732 that extends through one face of the handle P73 to allow the accommodation space 731 to be in communication with the outside.

When a diameter of the handle P73 is set to be larger than a diameter of the shaft P71, the shaft P71 may further include a base 713 to which the handle P73 is fixed. The base 713 may be formed as a disk fixed to the circumferential face of the shaft P71.

The handle P73 and the base 713 may be coupled to each other via a base fastening portion 734 disposed on the handle 73 and a handle fastening portion 714 disposed on the base 713.

The base fastening portion 734 may be formed as multiple protrusions fixed to the handle so as to be located inside the accommodation space 731, and the handle fastening portion 714 may be formed as a groove defined in the base 713 and accommodating the protrusion therein.

In order to facilitate the coupling of the handle P73 and the base 713, the handle P73 may have a fastening guide 735 positioned between one base fastening portion 734 and another base fastening portion 734, and the base 713 may have a guide groove 715 into which the fastening guide 735 is inserted. The guide groove 715 may be defined as a groove in which a circumferential face of the base 713 is bent toward the shaft through-hole 711.

The displaying portion P8 may include a housing P81 fixed to the fixed body 512 of the encoder and located inside the accommodation space 731 of the actuator, the display P84 fixed to the housing and displaying information (information related to control, operation, and the like of the laundry treating apparatus), and a circuit board (second circuit board and a displaying portion circuit board) P82 disposed in the housing and having a circuit for controlling the display P84.

The housing P81 may include a fastening body 81*b* fixed to the fixed body 512 by extending through the shaft through-hole 711 and being inserted into the body through-hole 514, and an accommodating body 81*a* fixed to the fastening body 81*b* and positioned inside the accommodation space 731.

The accommodating body 81*a* may be formed in any shape as long as it may be inserted into the accommodation space 731. A case in which the accommodating body 81*a* is formed in a cylindrical shape is shown as an example.

A mounting space 811 is defined inside the accommodating body 81*a*, and the mounting space 811 is in communication with the accommodation space 731 defined in the handle via an accommodating body through-hole 812 (the accommodating body through-hole is defined to be in communication with the handle through-hole). That is, the accommodating body through-hole 812 is defined in a face directed in a direction in which the handle through-hole 732 is located of the space provided by the accommodating body 81*a*.

The fastening body 81*b* may be formed in any shape as long as it is able to be inserted into the shaft through-hole 711 and the body through-hole 514 of the encoder. A case in which the fastening body 81*b* is formed in a cylindrical shape is shown as an example. The fastening body 81*b* has a fastening body through-hole 815 connected to the mounting space 811.

A fixed body fastening portion 816 may be disposed on a circumferential face of the fastening body 81*b*. The fixed body fastening portion 816 is means for fixing the housing P81 to the fastening body fixing portion 531 disposed in the encoder.

Further, multiple position setting protrusions 817 may be further disposed on the circumferential face of the fastening body 81*b*.

The position setting protrusion 817 is formed in a shape capable of being inserted into the position setting groove 532 defined in the encoder, and the position setting protrusion 817 is disposed at a point corresponding to a position of the position setting groove 532. The position setting protrusion 817 and the position setting groove 532 are means for minimizing a risk that the fixed body fastening portion 816 fails to be coupled to the portion 531 (means for ensuring the coupling of the fixed body fastening portion and the fastening body fixing portion) when the fastening body 81*b* is inserted into the body through-hole 514.

The second circuit board P82 may be inserted into the mounting space 811, and the wire 822 connected to the second circuit board P82 may be withdrawn to the outside of the housing P81 through the fastening body through-hole 815. Multiple lamps 821 may be disposed on the second circuit board P82.

The second circuit board P82 may control the display P84 to display preset information in response to an electrical signal generated from the signal generator 54 when the handle P73 is rotated.

In order to maintain a gap between the second circuit board P82 and the display P84 and to prevent damage to the lamp 821, a mounting portion P83 positioned between the display P84 and the second circuit board P82 may be disposed in the mounting space 811.

The mounting portion P83 may be formed as a mounting body 831 fixed to the accommodating body 81*a* and positioned inside the mounting space 811. The mounting body 831 may have any shape as long as it is able to be inserted into the mounting space 811.

A seating groove 832 to which the display P84 is fixed is defined in one face of the mounting body 831. The seating groove 832 may have a connector through-hole 836. A connector 841 (a flexible PCB or the like) disposed in the display P84 may be connected to the second circuit board P82 by being inserted into the connector through-hole 836.

The mounting body 831 may have a lamp through-hole 835 into which the lamp 821 is inserted. It is preferable that the number of lamp through-holes 835 is the same number as the number of the lamps 821, and a position of the lamp through-hole 835 should be set to a space of the mounting body located above the mounting groove 832 or a space of the mounting body located below the mounting groove 832. This is for light emitted from the lamp 821 to be transmitted to the outside of the housing P81 through the lamp through-hole 835.

The mounting portion P83 is fixed to the housing P81 via a mounting body fastening portion 813 disposed on the accommodating body 81*a* and an accommodating body fastening portion 833 disposed on the mounting body 831. The mounting body fastening portion 813 may be formed as multiple protrusions located inside the mounting space 811, and the accommodating body fastening portion 833 may be defined as a groove or the like defined in the circumferential face of the mounting body 831 (one face of the mounting body in contact with the accommodating body) and to which the mounting body fastening portion 813 is fixed.

The number of mounting body fastening portions 813 and the number of accommodating body fastening portions 833 should be set to be the same, and positions of the mounting body fastening portion 813 and the accommodating body fastening portion 833 should be set to correspond to each other.

In order to increase a fastening force of the mounting body 831, the accommodating body fastening portion 833 may include an upper fastening portion positioned higher than the seating surface 832 and a lower fastening portion positioned lower than the seating surface 832. Unlike the drawing, the accommodating body fastening portion 833 may be disposed on each of left and right sides of the seating face.

A window P85 may be further disposed on the accommodating body 81*a* to prevent water and foreign substances from flowing into the display P84 and the second circuit board P82.

Preferably, the window P85 is fixed to at least one of the accommodating body 81*a* and the mounting body 831 to close the accommodating body through-hole 812. The window P85 should be made of a material having a transparency that allows the information displayed on the display P84 and the light emitted from the lamp 821 to be viewed from the outside.

When the window P85 is fixed to the mounting body 831, the window P85 may have a cover fixing protrusion 851 protruding toward the mounting body 831, and the mounting body 831 may have a fixing protrusion fastening portion 834 to which the cover fixing protrusion 851 is coupled.

The second circuit board P82 may also be fixed to the mounting body 831. That is, the mounting portion P83 may have a protrusion protruding from the mounting body 831 toward the second circuit board 82, and the second circuit board 82 may have a protrusion through-hole 823 into which the protrusion is inserted.

Further, the window P85 may further include a cover sheet 853 for lowering the transparency of the cover. It is preferable that a transparency of the cover sheet is set to such a degree that it is difficult to view the interior of the mounting space 811 from the outside (the transparency of the cover sheet is set lower than the transparency of the cover). The cover sheet 853 may be fixed to a surface of the window P85, and a letter or symbol H may be displayed in an area of the cover sheet on which the lamp through-hole 835 is projected.

In one example, a lamp through-hole 835 corresponding to the input area D3 among the lamp through-holes 835 in the mounting portion P83 may provide a signal instructing the user to press the input area D3.

The selection portion R may be disposed inside the displaying portion P8. Specifically, the selection portion R may be formed as a component of the displaying portion P8 and may be disposed in the displaying portion P8 to be disposed inside the manipulation portion P7.

Accordingly, it may be seen that the displaying portion P8 includes the selection portion R that receives a determination command to determine the state information displayed on the display P84. Because the determination command determined by the selection portion R changes based on the state information, the selection portion R may correspond to a variable input means.

For example, when the selection information of the course and the option is displayed on the display P84, the selection portion R may be configured to input a determination command to select or determine the course and option. In addition, when a guide is displayed on the display P84, the selection portion R may be configured to input a determination command to identify the guide.

As a result, the selection portion R may be configured to, based on a type of the control command displayed on the display 84, receive a determination command for the user to identify or determine the corresponding control command.

The selection portion R may be configured to determine whether the control command displayed on the display P84 is selected by sensing whether the user's body is in contact with the window P85.

That is, the selection portion R may include a sensor R3 disposed on the second circuit board 82 and sensing the static electricity of the user's body, and a conductor R2 or a physical button R1 for connecting the sensor R3 and the window P85 to each other.

The selection portion R may be composed of a receiver R1 attached to or coupled to the window P85, and a transmitter R2 having one end connected to the receiver R1 and the other end connected to the sensor R3. In this case, the mounting body 831 must have a conductor through-hole 837 into which the transmitter R2 is inserted.

The receiver R1 is means for facilitating the input of the control command by expanding an area that the user may contact. In the control panel P having the above structure, the display area D1 is formed in an upper space of the window P85, and the input area D3 is formed in a lower space of the window P85. Therefore, when a width of the receiver R1 is set to be great, a width of the input area D3 is expanded, so that the user may more easily input the control command. The width of the receiver R1 is preferably set to equal to or smaller than ¼ to ½ of a width of the window P85.

The transmitter R2 and the receiver R1 may be formed as a conductor. Therefore, when the user's body is in contact with the transmitter R2 and the receiver R1, a current of the user's body may be charged or transmitted, so that the current may be transmitted to the sensor R3.

In addition, the transmitter R2 and the receiver R1 may be formed physical buttons. Therefore, when the user's body presses the receiver R1, the pressure of the body may be transmitted to the sensor R3.

The receiver R1 may be formed as a film that is printed or attached to a rear face of the window P85, and may be made of a carbon-based material or the like.

In one example, the displaying portion P8 may include inducing means 839 for inducing the user to press the selection portion R.

The inducing means 839 may guide the user to the location of the selection portion R to induce the user to press the selection portion R.

The inducing means 839 may include the lamp 821 and the lamp through-hole 835 corresponding to the position of the receiver R1. Specifically, the inducing means 839 may include the lamp through-hole 835 defined below the display P84 and the lamp 821 installed inside the lamp through-hole 835.

The lamp through-hole 835 and the lamp 821 constituting the inducting means 839 may be disposed below the display P84 and at a center of the mounting portion 83.

Accordingly, when the lamp 821 emits the light in the inducting means 839, the selection portion R or an area adjacent to the selection portion R may be brightened.

In addition, the lamp 821 of the inducing means 830 may be formed as an LED element and the like to indicate a separate character or phrase.

The control panel P having the above structure enables display of the control command, search for the displayed control command, and selection of the displayed control command, and enables minimization of a space required for installation. However, the control panel P having the above structure needs means to block the inflow of water or the foreign substances to the displaying portion P8 and the manipulation portion P7 or to discharge the inflowed water or foreign substances to the outside.

The control panel P having the above structure will display a preset control command on the display P84 whenever the user rotates the handle P73 (whenever the encoder generates the electrical signal) (search and change the control command).

When the desired control command is displayed on the display P84, the user may select the displayed control command via the selection portion R, and the control command selected via the selection portion R may be initiated when the user inputs an execution command via the executing portion P47.

In one example, the handle P73 is coupled to the first circuit board P4 to enable a rotational movement, whereas the housingP81 of the displaying portion is fixed to the first circuit board P4, so that it is necessary to keep a gap between the handle P73 and the housingP81 constant. This is because, when the gap between the handle P73 and the housingP81 is not maintained, the rotation of the handle 7P3 is likely to be constrained.

Figure 12:
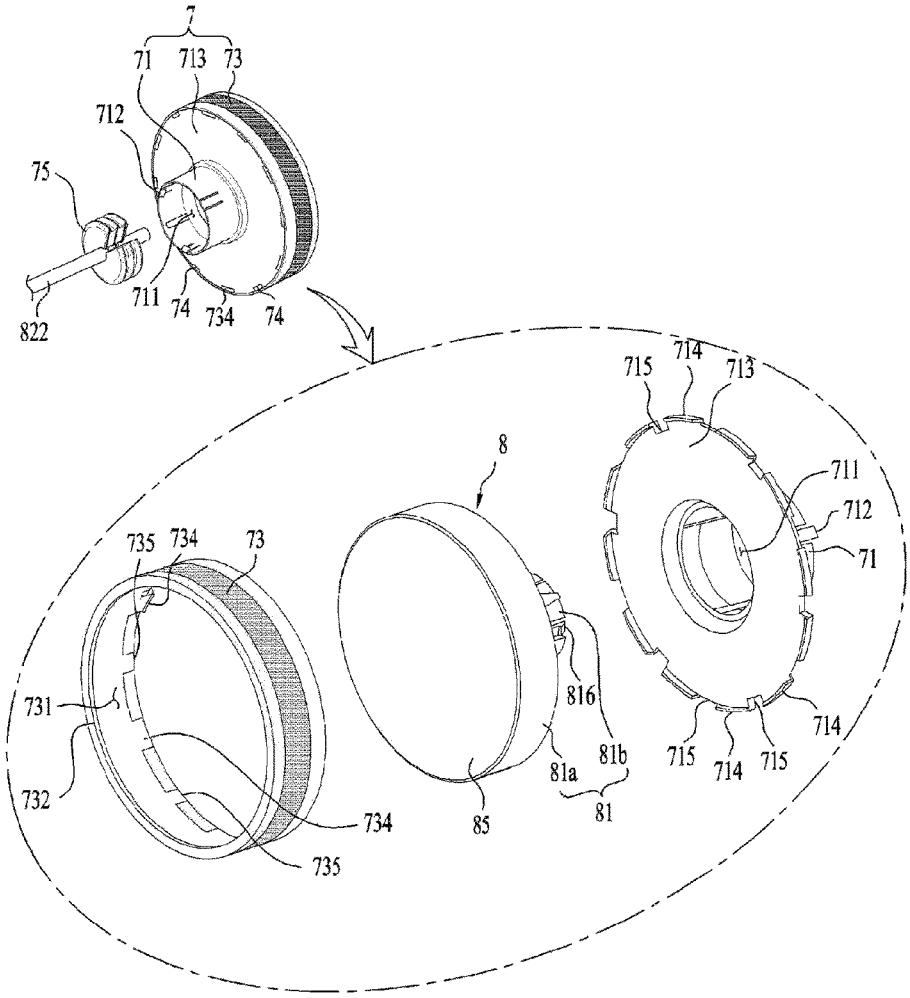
FIG. 12 shows an embodiment of utilization of the control panel.

FIG. 12 shows a detailed configuration of the manipulation portion P7.

The shaft P71 may be coupled to the encoder to rotate the encoder. The base P713 may extend from a distal end of the shaft to have a larger diameter than the shaft. The handle P75 may be coupled to the base to rotate the shaft and the encoder.

A diameter of the base 713 may be larger than a diameter of the panel through-hole. The base 713 may extend from the distal end of the shaft to face the panel through-hole.

The handle P73 may be coupled to an outer circumferential face of the base P713, and a diameter of the handle P75 may be greater than a width of the panel through-hole.

A diameter of the encoder P5 may be smaller than the width of the panel through-hole.

An outer circumferential face of the manipulation portion P7 may have a larger diameter than an outer circumferential face of the encoder P5.

The shaft P71 may be formed as a pipe having a shaft through-hole 711 defined therein. The rotating body 521 disposed in the encoder is inserted into the shaft through-hole 711, and the rotating body fastening portion 712 disposed on a circumferential face of the shaft P71 and located inside the shaft through-hole 711 is coupled to the shaft fastening portion 522 disposed in the rotating body. Accordingly, the shaft P71 is fixed to the rotating body 521 via the rotating body fastening portion 712 and the shaft fastening portion 522.

The handle P73 may be fixed to the shaft P71 so as to be located outside the cabinet 1, and the user may supply a force required for rotation of the rotating body 521 to the shaft P71 via the handle P73.

The handle 7P3 may include an accommodation space 731 defined inside the handle to be in communication with the shaft through-hole 711, and a handle through-hole 732 that extends through one face of the handle 73 to communicate the accommodation space 731 with the outside.

When a diameter of the handle P73 is set to be larger than a diameter of the shaft P71, the shaft 71 may further include a base 713 to which the handle P73 is fixed. The base 713 may be formed as a disk fixed to a circumferential face of the shaft P71.

The handle P73 and the base 713 may be coupled to each other via a base fastening portion 734 disposed in the handle 73 and a handle fastening portion 714 disposed in the base 713.

The interface P having the above-described structure enables the display of the control command, the search for the displayed control command, and the selection of the displayed control command, and minimizes the space required for the installation. However, the interface P of the above-described structure requires means for blocking the inflow of water or the foreign substances to the display portion P8 and the manipulation portion P7 or for discharging the introduced water or foreign substances to the outside.

The manipulation portion P7 may have means for discharging the water or the foreign substances flowed into the handle through-hole 732 to the outside of the accommodation space 731, and the display portion P8 may have means for blocking the inflow of the foreign substances (external air, liquid, dust, and the like) into the housing 81.

As described above, the manipulation portion P7 may discharge the water or the foreign substances introduced into the accommodation space 731 through the handle outlet P74 defined in the handle to the outside of the accommodation space.

Figure 13:
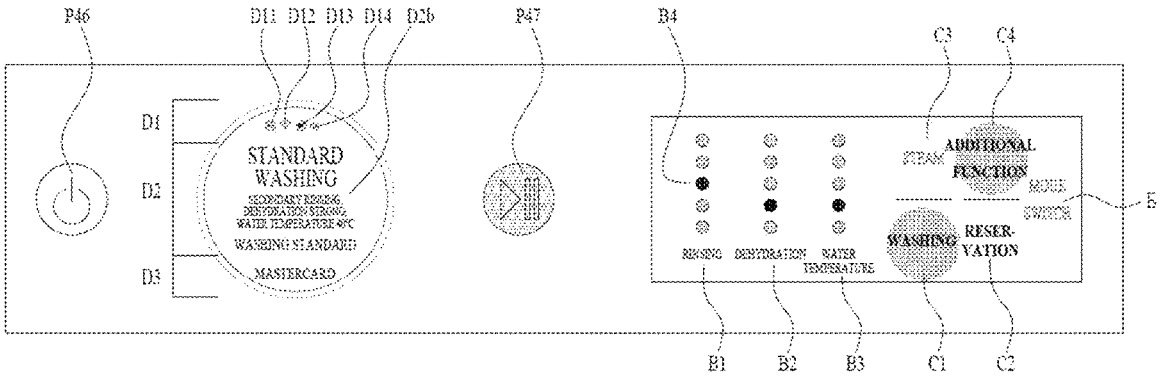
FIG. 13 shows the structure of a displaying interface according to the present disclosure.

FIG. 13 shows utilization of the control panel.

In the state display area D1 of the displaying portion P8, whether the door is locked, whether the communication module is activated, whether the course or the option is operated, whether the guide phrase is generated, and the like may appear in a form of an icon.

In addition, the number of displayed contents that may appear while rotating the manipulation portion P7 may be displayed in the state display area D1. For example, a plurality of dots may be arranged to be spaced apart from each other, and the number of contents displayed in the content display area D2 may be provided while one of the plurality of dots emits the light.

In the content display area D2, contents of the course and the option, the executed state of the course or the option, and the guide phrase necessary for the user may be displayed.

The content display area D2 may be larger than the state display area D1.

In the input area D3, light may be emitted to request the input of the user, and the guide phrase indicating which content the user should input may be displayed.

The power switch P46 may be disposed at a left side of the displaying portion P8, and the executing portion P47 may be disposed at a right side of the displaying portion P8.

The manipulation portion P7 may be rotatably disposed on an outer circumferential face of the displaying portion P8, and may rotate the drum 3.

The arbitrary course may be a series of control methods for performing the washing cycle (the drying cycle) of washing the laundry.

When the manipulation portion P7 is rotated, a name of the corresponding course and a simple option name may be displayed in the content display area D2 of the displaying portion P8 based on a set order, and a description of the course or the option may be displayed.

The option may be selected by the setting portion P2. The setting portion P2 may be configured to receive a selection command for selecting at least one of the arbitrary options.

The arbitrary option may include setting additional conditions of the course.

For example, the arbitrary option may be a set algorithm or a control method for adjusting at least one of the number of repetitions of each cycle to perform the course, an intensity of performing each cycle, a rotation speed of the drum when performing each cycle, a temperature of water, an amount of water, and a duration of each cycle.

The setting portion P2 may be formed as a touch display for selecting the arbitrary option, and may have a plurality of lamps and a plurality of conductor switches capable of sensing the user's body.

For example, the setting portion P2 may include option selection portion B that receives a setting command to set the conditions for the course, and option displaying portion B4 that displays option information corresponding to the option selection portion B.

For example, the option selection portion B may include rinsing means B1 for adjusting a rinsing force related to the rotation speed and duration of the drum, the amount of water, and the number of times of rinsing when the course performs the rinsing cycle, dehydration means B2 for adjusting a dehydration force related to the rotation speed and duration of the drum when the course performs the dehydration cycle, and temperature means B3 of adjusting a temperature of water when the course performs the washing cycle.

The option displaying portion B4 may be configured to indicate the rinsing force, the dehydration force, and the temperature in an objectified and unitized manner.

In one example, the setting portion P2 may have a utilizing means C that receives a utilization command to utilize a function of the laundry treating apparatus.

For example, the utilizing means C may include washing means C1 for inputting a special washing cycle such as functional laundry washing, soft laundry washing, and tub washing, reservation means C2 for inputting a reservation command to perform the washing course at a specific time, sterilizing means C for promoting sterilization by adding steam to the laundry during the course cycle, and additional function means C4 for utilizing additional functions such as pairing with other devices.

In addition, the setting portion P2 may include switching portion E for receiving a connection command to be in communication with the laundry drying apparatus 20 or the mini apparatus 60.

In one example, the setting portion P2 allows a function that may be utilized at a present time point or a function selected by the user to be turned on and allows a function that is not able to be executed or is not selected by the user to be turned off.

The setting portion P2 may display all of the contents via an auxiliary display P19.

Hereinafter, an embodiment and a control method for displaying and controlling the laundry drying apparatus 20 or the mini apparatus 60 with the control panel P of the laundry washing apparatus 10 will be described. However, this is only for omitting repetitive descriptions, and is able to be equally applied when controlling the laundry washing apparatus 10 or the mini apparatus 60 with the drying control panel PA.

In addition, the same may be applied when controlling the laundry washing apparatus 10 or the laundry drying apparatus 20 with the mini control panel PC. FIG. 14 is a diagram showing the structure of a displaying interface according to the present disclosure.

The displaying interface may include a mounting portion 83 disposed inside a circular handle 71 of the manipulation portion, and a display 84 accommodated on a front surface or exposed surface of the mounting portion 83.

Referring to FIG. 14(*a*), the mounting portion P83 may include the mounting body 831 accommodated in the manipulation portion P7. The mounting body 831 may have a circular cross-section not to interrupt rotation of the manipulation portion P7 along an outer circumferential surface thereof.

The mounting body 831 may accommodate the circuit board P82 for controlling the displaying interface inside. Since the mounting body 831 is formed of reinforced plastic or synthetic resin for easy molding, a space for mounting the circuit board P82 may be provided on a rear surface of the mounting body 831 or inside the mounting body 831.

The mounting body 831 may be provided to allow light of the lamp 821 or an LED device to be transmitted to the state display area D1 of the displaying interface P8 through the plurality of lamp through-holes 835.

The lamp through-hole 835 may also be provided below the mounting body 831 to allow light of the lamp 821 or the LED device corresponding to the selection portion R to be transmitted to the input area D3 of the display P8. Thus, the lamp 821 or the LED device may be turned on and off repeatedly to induce input of the selection portion R.

The mounting body 831 may include the seating groove 832 for centrally accommodating or fixing the display P84. The seating groove 832 may be recessed to a predetermined depth in the exposed surface or the front surface of the mounting body 831, and may have a shape corresponding to an outer circumferential surface of the display 84.

The seating groove 832 may be disposed between the lamp through-holes 835 disposed thereabove and the lamp through-holes 835 disposed therebelow.

The seating groove 832 may have a longer width than a height or a width to ensure an installation area of the display P84. The seating groove 832 may be provided not to pass through the mounting body 831 to support the display 84.

The mounting portion P83 may further include the connector through-hole 836 provided through the mounting body 831. The connector through-hole 836 may connect the circuit board P82 and the display P84 to allow the control line 841, which transmits a control signal generated from the circuit board P82 to the display P84, to pass therethrough. The connector through-hole 836 may be provided to pass through the inside of the seating groove 832.

The connector through-hole 836 may be formed on any one of both sides of the seating groove 832. This is because, since the control line 841 is disposed at both ends of the display P84, the control line 841 is not bent or pressed and is guided to the circuit board P82. Thus, noise, etc. may be presented from being generated.

The connector through-hole 836 may be disposed to be inclined toward any one of the left and right side surfaces or upper and lower surfaces of the seating groove 832. The connector through-hole 836 may be disposed in contact with any one of left and right side surfaces of the seating groove 832.

Referring to FIG. 14(*b*), the display P84 may be supported by and fixed to the inside of the seating groove 832.

The display P84 may include a liquid crystal 843 for visually displaying a control signal selected to be displayed on the circuit board P2, a connector 842 extending from the circuit board P82 to transmit a signal of the circuit board P82 to the liquid crystal 843, and a harness 842 disposed on one surface of the liquid crystal 843 and connected to the connector 842.

The liquid crystal 843 may be provided in a rectangular shape, and may be provided to variably display visual information, such as an LED panel or an LCD panel. Since the liquid crystal 843 visually expresses the signal generated by the circuit board P82, the liquid crystal 843 may display boot information, selection information of a course and an option, performance information of the course and the option, and completion information of the course and the option.

The liquid crystal 843 may also display a remote control state controlled by the external terminal 40 and information received from the server 10.

The harness 842 may be coupled to a side surface of the liquid crystal 843 and may be provided in parallel to the liquid crystal 843. Thus, the entire thickness of the displaying interface P8 may be prevented from being expanded.

The harness 842 may be provided in a plastic series, and a surface of the harness 842 may be provided in a rectangular parallelepiped shape to fix a free end of the control line 841 therein.

The control line 841 may be connected to the harness 842 to extend up to the circuit board P82. The control line 841 may be provided in the form of a thin band provided in parallel with surfaces of the harness 842 and the liquid crystal 843. Accordingly, the control line 841 may prevent the entire thickness of the displaying interface P8 from being expanded.

The control line 841 may be provided in any shape as long as the control line 841 is provided to transmit an electrical signal FIG. 15 is a diagram showing the structure of the display P8.

The displaying interface P8 may be fixed inside the manipulation portion P7 to display state information of a course selected by the manipulation portion P7. In addition, the displaying interface P8 may display state information of the controllers P1 and P2, and may display state information transmitted from the external terminal 40, the server 50, or the like.

In addition, the displaying interface P8 may display state information including notification information to a user, and may also display state information requesting confirmation of the user.

Here, the state information may be defined as a concept being displayed on the displaying interface P8 and including all information recognizable by the user through the laundry treating apparatus, and as a result, the displaying interface P8 may display all state information related to the laundry treating apparatus.

The displaying interface P8 may display state information through the display P84 and the state unit D11.

The display P84 may include a liquid crystal to be described below and may display a plurality of state information. The displaying interface P8 may appropriately display state information required at a corresponding time point among the plurality of state information through the display P84. As a result, the state information displayed on the display P84 may vary depending on an operating time or situation of the laundry treating apparatus, and the display P84 may display arbitrary state information among the plurality of state information.

However, the state unit D11 may include the plurality of the lamps 821 described above. Since the plurality of the lamps 821 inevitably transmits a signal through turning on and off, state information to be displayed through the plurality of the lamps 821 may be more limited than that of the display P84. Accordingly, the state unit D11 may display only specific state information among the plurality of pieces of state information.

The plurality of the lamps 821 included in the state unit D11 may be set to display preset state information, respectively.

For example, the plurality of lamps 821 may include a door lamp 8211 for displaying state information in which the door is locked. When the door lamp 8211 is turned on, this may correspond to the case in which state information indicating that the door is locked in the cabinet is displayed to the outside. To this end, in an area of a window P85 corresponding to the door lamp 8211, an icon (e.g., a key icon) related thereto may be displayed.

The plurality of lamps 821 may include a communication lamp 8212 for displaying state information indicating that the communication module T1 is activated. When the communication module T1 is activated, this may mean that the communication module T1 is connected to the AP 30.

When the communication lamp 8212 is turned on, this may correspond to the case in which state information indicating that the communication module T1 is connected to the AP 30 or the external terminal 40 is displayed to the outside. To this end, in an area of the window P85 corresponding to the communication lamp 8212, an icon (e.g., a key WiFi icon) related thereto may be displayed.

The plurality of lamps 821 may include a remote lamp 8213 indicating state information remotely controlled by the external terminal 40. When the remote lamp 8213 is turned on, this may correspond to the case in which state information indicating that the laundry treating apparatus is operated by the external terminal 40 is displayed to the outside. To this end, in an area of the window P85 corresponding to the remote lamp 8213, an icon (e.g., a start/stop icon) related thereto may be displayed.

The plurality of lamps 821 may include a lock lamp 8214 indicating state information in which input of the input means P9 including the manipulation portion P7 is inactivated.

When the lock lamp 8214 is turned on, this may correspond to the case in which state information indicating that input of the input means P9 including the manipulation portion P7 is inactivated is displayed to the outside. To this end, in an area of the window P85 corresponding to the lock lamp 8214, an icon (e.g., a prohibition icon) related thereto may be displayed.

The state unit D11 may be disposed above the display P84.

This is because the state unit D11 does not need to be input by a user and there is no possibility that the display P84 is shielded due to the state unit D11.

Since the state unit D11 is configured to display preset state information to the outside, the state unit D11 may be selectively turned on above the display P84 to intuitively transmit the state information to the user.

The selection portion R may be disposed below the display P84 in order to prevent at least a portion of the display P84 from being shielded by the user's body when a signal of the selection portion R is input since the selection portion R is in contact with the user's body.

The user may input a signal of the selection portion R while continuously checking determination information displayed on the display P84.

The display P84 may be accommodated on the mounting portion P83. The plurality of lamps 821 that emits light to transmit information corresponding thereto through the state unit D11 may be disposed above the display P84. An icon may be presented at a position corresponding to the lamp 821 in the window P85.

The plurality of lamps 821 may be coupled to the circuit board P82 and may be controlled.

Icons corresponding to state information may be disposed depending on the number of the lamps 821 disposed above the display P84. For example, when the four lamps 821 are provided, a lock icon, a WiFi icon, a run/stop icon, a remote control icon, a speaker notification icon, a button lock icon, or the like may be printed on the window P85. Thus, when state information corresponding thereto is generated, the circuit board P82 may turn corresponding lamps 8211 to 8214.

Since the circuit board P82 and the plurality of lamps 821 are positioned on a rear surface of the mounting body 831 or inside the mounting body 831, light emitted from the plurality of lamps 821 needs to reach the window P85. Thus, the lamp through-holes 835 defining a path in which light generated from the lamp 821 reaches the window P85 through the mounting body 831 may be disposed in the mounting portion P83.

The lamp through-holes 835 may be provided in the number corresponding to the plurality of lamps 821, and may be provided through the mounting body 831 at positions overlapping the plurality of lamps 821.

The displaying interface P8 may display a selection area D3 below the display P84 and the selection area D3 may be configured to receive input from the user. Thus, the displaying interface P8 may transmit the user's intention to the control panel P by transmitting the input received from the user to the circuit board P82.

In general, the input means P9 that receives the input of the user may be the manipulation portion P7, the executing means P47, and the setting portion P2, which may be positioned outside the display P8, and the displaying interface P8 may be configured to display information generated by the control panel P. Thus, in a general situation, it may not be required to receive the input from the user through the selection portion R.

However, a notification may be displayed to the user through the display P8, or information requesting confirmation of the user may be displayed. When the user inputs the displaying interface P8 and transmits a command for confirming the information to the control panel P, the user may receive feeling of being in close communication with the control panel P.

To this end, the displaying interface P8 may further include the selection portion R for receiving the user's intention, such as confirmation of the displayed information from the user or selection of the displayed information.

In a process in which the control panel P controls the laundry treating apparatus, confirmation of the user or a determination command may be required, and the control panel P may display the content or request of the determination command to the displaying interface P8 through the circuit board P82 on the display P84.

In addition, the circuit board P82 is configured to allow the selection portion R to respond to the input only when the user's intention needs to be received, and when the user's intention is not required to be input, the selection portion R may be configured in such a way that the selection portion R does not react even if a signal of the selection portion R is input. Accordingly, the control panel P may perform to activate the input of the selection portion R only when confirmation of the user or the determination command is required.

The displaying interface P8 may include an inducing means 839 for displaying to the user that confirmation or request of the determination command is required by displaying whether input of the selection portion R is activated.

The inducing means 839 may include a lower lamp or a luminous body 821*a* coupled to the circuit board P82 and disposed below the display P84. In addition, the inducing means 839 may include an induction hole 835*a* for exposing the lower lamp 821*a* through the mounting portion P83.

The induction hole 835*a* may be provided as a transmission hole since the light emitted from the lower lamp 821*a* is provided to pass through the mounting portion P83. The lower lamp 821*a* may be provided as a luminous body that emits light, and may be spaced apart from the display P82 to emit light to guide touch of the selection portion R.

For example, the circuit board P82 may be configured in such a way that the lower lamp 821*a* is disposed below the display P84, and when input of the selection portion R is activated, the lower lamp 821*a* may be turned on.

The lower lamp 821*a* may be provided as a panel such as an LED to display a determination command to be input to the selection portion R, and may turn on the lower lamp 821*a* while displaying a determination command corresponding to input of the selection portion R in a lower region of the display P84.

The lower lamp 821*a* may be disposed at the center based on the left and right sides of the mounting portion P83. Therefore, the inducing means 839 may allow the lower lamp 821*a* to be turned on at the lower center of the display P84, thereby maximizing aesthetics sensation than inclined to one side.

When the inducing means 839 is turned on, the user may input of the selection portion R by recognizing that a determination command is required.

The selection portion R may be provided integrally with the inducing means 839, and thus input of the inducing means 839 may be regarded as the input of the selection portion R.

However, the inducing means 839 may include the lamp 821 for emitting light, and the selection portion R may include the sensor R3, and accordingly, it may be difficult to design these component as one component. In particular, if the lamp 821 and the sensor R3 are disposed together, the sensor R3 may block light emitted from the lamp 821, and the lamp 821 may transmit noise or an erroneous signal to the sensor R3. Accordingly, the selection portion R may be spaced apart from the inducing means 839.

As a result, the sensor hole 837 may be spaced apart from the induction hole 835*a*. The induction hole 835*a* may be disposed between the seating groove 832 and an inner circumferential surface of the mounting body 831. The sensor hole 837 may be disposed between the seating groove 832 and an inner circumferential surface of the mounting body 831. The sensor hole 837 may be disposed in an area except between the induction hole 835*a* and an inner circumferential surface of the mounting body 831.

The selection portion R may include the sensor R3 coupled to the circuit board P82 to receive a determination command, a transmitter R2 for transmitting the determination command to the sensor R3, and the receiver R1 that extends to the window P85 from the transmitter R2 to be in contact with the user's body.

The receiver R1 may be attached to a rear surface of the window P85. Thus, the transmitter R2 may be formed to penetrate the mounting body 831, and the mounting body 831 may include the sensor hole 837 that provides a space through which the transmitter R2 passes.

The receiver R1 and the transmitter R2 may be provided as conductors, and thus when the user's body approaches, the receiver R1 and the transmitter R2 may be charged by current flowing in the user's body, or may be configured to receive current from the body. Accordingly, the user may be in contact with the receiver R1 to input the determination command.

Current transmitted to the receiver R1 may be transmitted to the sensor R3 through the transmitter R2, and the circuit board P82 may detect user's contact to receive the determination command.

In general, the user may input the determination command by touching an area in which the transmitter R2 is installed.

The window P85 may cover the inducing means 839 and the selection portion R, and the user may not recognize the position of the selection portion R. The inducing means 839 may induce input of the selection portion R using a method of emitting light or the like, and thus the user may recognize only the position of the inducing means 839 based on the light emitted from the inducing means 839.

Accordingly, the user may consider the inducing means 839 as the selection portion R and may touch an area in which the inducing means 839 of the window P85 is installed. In this case, when a signal of the selection portion R is not input, the user may doubt performance of the control panel P.

Accordingly, even if the transmitter R2 of the selection portion R is spaced apart from the inducing means 839 by a predetermined distance, the receiver R1 may extend to an area surrounding at least a portion of the inducing means 839 from the transmitter R2 to detect the user's body that presses the inducing means 839.

The receiver R1 may be provided to surround both sides and a lower portion of the inducing means 839, and may be provided to cover an entire area to the inner circumferential surface of the mounting portion P83 from a lower portion of the display P84 and a circumference of the inducing means 839.

Accordingly, any portion of the user's body that touches a lower portion of the display P84 may be detected, and current generated from the user's body may be moved to the transmitter R2.

As a result, even if the user inputs a signal of the inducing means 839, an effect of inputting a signal of the transmitter R2 may be achieved due to a shape of the receiver R1.

FIG. 16 is a diagram showing an embodiment showing display arrangement of a displaying interface according to the present disclosure.

Referring to FIG. 16(*a*), the seating groove 832 may be provided symmetrically with respect to the center of the mounting body 831.

A left surface or a first surface 832*a* and a right surface or a second surface 832*b* of a circumferential surface of the seating groove 832 may be spaced apart from each other by a constant interval based on the center of the mounting body 831. A length between the first surface 832*a* and the inner circumferential surface of the mounting body 831 may be the same as a length between the second surface 832*b* and the inner circumferential surface of the mounting body 831.

Thus, the display P8 may be fixed inside the mounting body 831 not to be inclined to the left or right.

The seating groove 832 may be recessed to a predetermined depth from the mounting body 831, and a circumferential surface of the seating groove 832 may protrude from the mounting body 831 to a predetermined depth to form the seating groove 832.

An interval between the first surface 832*a* and the second surface 832*b* of the seating groove 832 may correspond to the entire width of the harness 842 and the liquid crystal 843. The first surface 832*a* may be provided to contact and support the harness 842, and the second surface 832*b* may contact and support the liquid crystal 843.

The mounting body 831 may further include a connector through-hole 837 through which the control line 841 passes through the mounting body 831. Since the display P84 is disposed on a front surface or an exposed surface of the mounting body 831 and the circuit board P82 is disposed inside the mounting body 831 or on a rear surface thereof, the connector through-hole 837 may provide a space through which the control line 841 for connecting the circuit board P82 and the harness 842 passes.

The connector through-hole 837 may be formed through the seating groove 832.

The connector through-hole 837 may be formed through the mounting body 831 from any one of both ends of the seating groove 832.

Since the harness 842 is supported at either end of the seating groove 832, when the connector through-hole 837 is placed at either end of the seating groove 832, the control line 841 extending from the harness 842 may be inserted into the connector through-hole 837 with the shortest distance. Accordingly, it may be possible to minimize a space that is occupied by the control line 841 independently from other components inside the displaying interface P8.

The harness 842 may be supported on the first surface 832*a*, and thus the connector through-hole 837 may be provided adjacent to or in contact with the first surface 832*a*.

Referring to FIG. 16(*b*), the display P84 may be accommodated on the seating groove 832. Thus, a free end of the liquid crystal 843 may be supported on the second surface 832*b*, and a free end of the harness 842 may be supported on the first surface 832*a*. As a result, the display P84 may be supported by the seating groove 832 and may be disposed on the center of the mounting body 831.

However, even if the display P84 is disposed on the center of the mounting body 831 due to the seating groove 832, this may not mean that the liquid crystal 843 is disposed on the center of the mounting body 831.

The exposed surface of the display P84 may be configured by a combination of the harness 842 and the liquid crystal 843. Thus, the liquid crystal 843 may be inevitably disposed to be inclined in a direction opposite to a direction in which the harness 842 is disposed in the seating groove 832 due to the harness 842.

As a result, when the display P84 is accommodated on the seating groove 832, a distance D3 from the center C of the mounting body to a free end of the liquid crystal 843 or the second surface 832*b* may be longer than a distance D1 from the center C of the liquid crystal 843 to a fixed end or the harness 842. Thus, the liquid crystal 843 may be disposed to be relatively inclined toward the second surface 832*b* by D2 that is a difference between a distance D3 from the center C of the mounting body to the second surface 832*b* and a distance D1 from the center C of the mounting body to the harness 842. The difference D2 may correspond to the width of the harness 842.

Accordingly, the liquid crystal 843 may be inclined to an opposite side to the harness 842 by D2 from the entire displaying interface P8, and content displayed on the liquid crystal 843 may be inevitably inclined to one side based on the center of the displaying interface P8.

Therefore, not only the aesthetics sensation is decreased, but the performance of the display P8 may also be made suspicious FIG. 17 is a diagram showing an embodiment in which the liquid crystal 843 is disposed at the center of the display P8.

Referring to FIG. 17(*a*), the mounting portion P83 may be provided to place the liquid crystal 843 at the center. In detail, the seating groove 832 may be provided to place the harness 842 adjacent to the inner circumferential surface of the mounting body 831 compared with the liquid crystal 843.

The seating groove 832 may be provided inclined in a direction in which the harness is disposed from the center of the mounting body 831.

The seating groove 832 may be disposed inclined toward the inner circumferential surface of the mounting body 831 from the center C of the mounting body by the width D2 of the harness 842. In detail, the first surface 832*a* may be disposed closer to the inner circumferential surface of the mounting body 831 than the second surface 832*b*.

In other words, the seating groove 832 may be provided to move the liquid crystal 843 by the width of the harness 842 in a direction in which the harness 842 is arranged. Accordingly, the liquid crystal 843 may compensate for inclination of the liquid crystal 843 to one side by the harness 842.

Referring to FIG. 17(*b*), an interval D4 to a free end or outer surface of the liquid crystal 843 from the center C of the mounting portion and an interval D4 to a contact surface between the liquid crystal 843 and the harness 842 from the center C of the mounting portion may be the same, which means a predetermined error at a level to be determined to be bilaterally symmetric by the human eye. Needless to say, the error may be smaller than the width D2 of the harness 842.

The mounting portion P83 may include a support surface 838 that protrudes along a circumference of the mounting body 831 and on which the window P85 is accommodated. The first surface 832*a* for supporting the harness 842 may be disposed closer to the support surface than the second surface 832*b* that supports the liquid crystal 843. As a result, a vertex of the first surface 832*a* may be disposed closer to the inner circumferential surface of the mounting body than a vertex of the second surface 832*b*.

As a result, the harness 842 may be disposed close to the inner circumferential surface of the mounting body 841. The free end of the harness 842 may be disposed closer to the inner circumferential surface of the mounting body 841 than the free end of the liquid crystal 843.

An interval between a vertex 832*c* of the first surface and the inner circumferential surface of the mounting body 831 may be smaller than an interval between a vertex of the second surface 832*b* and the inner circumferential surface of the mounting body 831.

Thus, a region between the first surface 832 and the inner circumferential surface of the mounting body 831 may be used as a region of the display P84 as much as possible.

FIG. 18 is an enlarged view of a vertex of the seating groove 832 shown in FIG. 16.

The support surface 838 provided along a circumference of the mounting body 831 may have a reference thickness T3 for supporting the window P85.

In order to compensate for a length corresponding to the width of the harness 842, the first surface 832*a* of the seating groove 832 may be provided in contact with the support surface 838. Thus, the maximum area of the mounting body 831 limited by the manipulation portion P7 may be used as an area of the seating groove 832.

The first surface 832 may be disposed close to the support surface 838 in such a way that the vertex 832*c* of the first surface 832 is inserted into the support surface 838.

As the entire width of the liquid crystal 843 is extended, the harness 842 may be inevitably disposed close to the support surface 838. In addition, even if there is a gap between the second surface 832*b* corresponding to the free end of the liquid crystal 843 and the support surface 838, the second surface 832*b* may not be further extended only to an area in which the first surface 832*a* is in contact with the support surface 838 for symmetry of the liquid crystal 843.

The vertex 832*c* of the first surface may be disposed inside the support surface 838. The vertex 832*c* of the first surface may be provided as inserted into the support surface 838. An interval T1 to an outer circumferential surface of the support surface 838 from the vertex 832*c* of the first surface may be smaller than a thickness T3 of the support surface 838.

In the support surface 838, a region facing the vertex 832*c* of the first surface may have a thinner thickness than other portions.

The first surface 832*a* may be disposed close to the support surface 838 or the outer circumferential surface of the mounting body 831. Thus, the second surface 832*b* may also be designed close to the support surface 838 to increase the area of the liquid crystal 843.

A partial area of the seating groove 832, which is occupied by the support surface 838, may be used as a space in which the display P84 is disposed, and may be used as a space in which the harness 842 is disposed, thereby maximizing the size of the liquid crystal 843.

The vertex 832*c* of the first surface may be disposed through the support surface 838 (refer to FIG. 11). Portions of the support surface 838 or the inner circumferential surface of the mounting body 831, which correspond to both ends of the first surface 832*a*, may be provided through penetration.

In other words, the first surface 832*a* may be disposed closer to the support surface 838 or the inner circumferential surface of the mounting body 831 than the second surface 832*b*, and the length of the first surface 832*a* may be smaller than the length of the second surface 832*b*. This is because a length corresponding to the vertex 832*c* of the first surface is omitted.

Thus, the first surface 832*a* may be provided close to the mounting body 831, and the second surface 832*b* may be designed close to the mounting body 831. Accordingly, the area of the liquid crystal 843 may be extended.

For example, the first surface 832*a* may be disposed close to the support surface 838 until the vertex of the second surface 832*b* comes in contact with the support surface 838.

FIG. 19 is a diagram showing another embodiment of the mounting portion.

When the vertex 832*c* of the first surface 832*a* is disposed inside the support surface 838, an interval between the vertex 832*c* and the outer circumferential surface of the support surface 838 may be too narrow.

Accordingly, the rigidity of the support surface 838 facing the vertex 832*c* may be weakened, and in severe cases, the support surface 838 may be damaged.

To prevent this, at least one of both vertices of the first surface 838*a* may include a curved portion 838*d* having a radius of curvature.

That is, both ends of the first surface 838*a* may be provided with a curve like the support surface 838 rather than being provided like corners of a polygon.

The curved portion 838*d* may be provided with a greater curvature than the support surface 838. The curved portion 838*d* may have a curvature corresponding to the curvature of the support surface 838.

Accordingly, an interval T2 between the curved portion 838*d* and the outer circumferential surface of the support surface 838 may be larger than an interval T1 between the vertex 838C and the outer circumferential surface of the support surface 838.

Accordingly, the rigidity of the support surface 838 may be reinforced.

The display P84 may also have a curve corresponding to the curved portion 838*d*. For example, a vertex of the free end of the harness 842 may include a chamfering 842*a* to be engaged with the curved portion 838*d*.

Since the harness 842 is formed of a plastic-series material and is easily molded, the chamfering 842*a* may be provided only in the harness 842, and the liquid crystal 843 may be provided as it is in a rectangular shape.

The vertex of the free end of the liquid crystal 843 is sufficiently spaced apart from the support surface 838, and thus the vertex of the free end of the liquid crystal 843 needs not be chamfered. Thus, both vertexes of the second surface 832*b* may not include a curved portion.

The present disclosure may be modified and implemented in various forms, but the scope of the rights is not limited to the above-described embodiments. Therefore, when the modified embodiment includes the elements of the claims of the present disclosure, it needs to be regarded as belonging to the scope of the present disclosure.

The invention claimed is:

1. A laundry treating apparatus comprising:

a cabinet;

a drum rotatably disposed inside the cabinet and configured to receive laundry;

a manipulation portion rotatably coupled to the cabinet and configured to receive a selection command for selecting one or more courses to be performed by rotating the drum; and a displaying interface fixed inside the manipulation portion and configured to display state information including a state of a selected course that is selected among the one or more courses via the manipulation portion, wherein the displaying interface comprises:

a display configured to change the state information based on rotation of the manipulation portion, a selection portion configured to receive a determination command for selecting state information that is displayed on the display and requests confirmation of a user, the selection portion including a receiver configured to expand a contact area available for the user to input the determination command, and a state unit disposed above the display, the state unit comprising a plurality of lamps configured to be turned on to thereby selectively indicate one or more preset states of the laundry treating apparatus.

2. The laundry treating apparatus of claim 1, wherein the displaying interface comprises:

a mounting body that accommodates the display; and a circuit board that is disposed at a rear side of the display, the plurality of lamps being installed on the circuit board, and wherein the mounting body defines:

a seating groove that accommodates the display, and a lamp hole that exposes one or more of the plurality of lamps to an outside of the displaying interface, the lamp hole being defined above the seating groove and passing through the mounting body.

3. The laundry treating apparatus of claim 2, wherein the mounting body defines a plurality of lamp holes including the lamp hole, and wherein a number of the plurality of lamp holes is equal to a number of the plurality of lamps.

4. The laundry treating apparatus of claim 1, further comprising:

a door configured to open and close an opening defined at the cabinet, wherein the plurality of lamps comprise a door lamp configured to be turned on to thereby indicate whether the door is locked to the cabinet.

5. The laundry treating apparatus of claim 1, further comprising:

a communication module configured to communicate with an external terminal, the external terminal being configured to remotely control the one or more courses or an option, wherein the plurality of lamps comprise at least one of:

a communication lamp configured to be turned on to thereby indicate whether the communication module is activated, or a remote lamp configured to be turned on to thereby indicate whether the external terminal remotely controls the one or more courses.

6. The laundry treating apparatus of claim 1, further comprising:

a setting portion configured to receive a lock command for inactivating the manipulation portion from receiving an input of the selection command to the manipulation portion, wherein the plurality of lamps comprise a lock lamp configured to be turned on to thereby indicate whether the manipulation portion is inactivated.

7. The laundry treating apparatus of claim 1, wherein the selection portion is disposed below the display.

8. The laundry treating apparatus of claim 7, further comprising:

a luminous body spaced apart from the display and disposed below the display, the luminous body being configured to emit light to thereby guide touch of the selection portion.

9. The laundry treating apparatus of claim 8, wherein the displaying interface comprises:

a mounting body that accommodates the display; and a circuit board disposed at a rear side of the display, the luminous body being mounted on the circuit board, and wherein the mounting body defines a transmission hole configured to guide light emitted from the luminous body forward.

10. The laundry treating apparatus of claim 1, wherein the displaying interface comprises:

a mounting body that defines a seating groove accommodating the display; and a circuit board that is disposed at a rear side of the display, the plurality of lamps being installed on the circuit board, wherein the display comprises:

a liquid crystal, a control line that extends from the circuit board and is configured to transmit a signal from the circuit board to the liquid crystal, and a harness disposed at a surface of the liquid crystal and connected to the control line, wherein the mounting body defines a connector through-hole that receives the control line passing through the mounting body, and wherein the connector through-hole is defined at a position that is offset toward a left or right side surface of the seating groove, or toward an upper or lower surface of the seating groove.

11. The laundry treating apparatus of claim 10, wherein the connector through-hole is in contact with the left or right side surface of the seating groove.

12. The laundry treating apparatus of claim 10, wherein the liquid crystal is positioned at a center of the mounting body, and wherein the seating groove is disposed offset toward a direction in which the connector through-hole is offset with respect to the center of the mounting body.

13. The laundry treating apparatus of claim 12, wherein the seating groove comprises:

a first surface that faces an outer surface of the harness; and a second surface that faces an outer surface of the liquid crystal and is disposed opposite to the first surface, and wherein an inner circumferential surface of the mounting body is disposed closer to the first surface than to the second surface.

14. The laundry treating apparatus of claim 13, wherein the inner circumferential surface of the mounting body is disposed closer to a vertex of the first surface than to a vertex of the second surface.

15. The laundry treating apparatus of claim 13, wherein an interval between a vertex of the first surface and the inner circumferential surface of the mounting body is less than an interval between a vertex of the second surface and the inner circumferential surface of the mounting body.

16. The laundry treating apparatus of claim 13, wherein the displaying interface comprises:

a window that is disposed at a front side of the mounting body and covers a surface of the display from an outside of the laundry treating apparatus; and a support surface that extends along a circumference of the mounting body and accommodates the window, and wherein the support surface is disposed closer to the first surface than to the second surface.

17. The laundry treating apparatus of claim 16, wherein a vertex of the first surface faces the support surface based on the window being inserted into the support surface.

18. The laundry treating apparatus of claim 16, wherein a thickness of a portion of the support surface that faces a vertex of the first surface is less than a thickness of other portions of the support surface.

19. The laundry treating apparatus of claim 16, wherein the first surface comprises a curved portion disposed at a vertex of the first surface.

20. The laundry treating apparatus of claim 19, wherein the harness has chamfers that are defined at ends of the harness and engaged with the curved portion.

21. The laundry treating apparatus of claim 20, wherein the second surface does not include a curved portion at ends of the second surface, and wherein the liquid crystal does not include chamfers at ends of the liquid crystal.

22. The laundry treating apparatus of claim 16, wherein the first surface has a vertex that passes through the support surface.

23. A laundry treating apparatus, comprising:

a cabinet;

a drum rotatably disposed inside the cabinet and configured to receive laundry;

a manipulation portion rotatably coupled to the cabinet and configured to receive a selection command for selecting one or more courses to be performed by rotating the drum;

a displaying interface fixed inside the manipulation portion, the displaying interface comprising a display configured to display at least one of (i) a state of a selected course that is selected among the one or more courses via the manipulation portion, or (ii) a determination command for requesting confirmation of a user; and a selection portion disposed inside the displaying interface and configured to receive the determination command, the selection portion being disposed below the display and including a receiver configured to expand a contact area available for the user to input the determination command.

* * * * *